US007268750B2

(12) United States Patent
Isono et al.

(10) Patent No.: US 7,268,750 B2
(45) Date of Patent: Sep. 11, 2007

(54) METHOD OF CONTROLLING IMAGE DISPLAY

(75) Inventors: Aoji Isono, Kanagawa (JP); Tatsuro Yamazaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 11/226,821

(22) Filed: Sep. 13, 2005

(65) Prior Publication Data

US 2006/0007069 A1 Jan. 12, 2006

Related U.S. Application Data

(62) Division of application No. 09/719,523, filed as application No. PCT/JP99/05473 on Oct. 5, 1999, now Pat. No. 6,972,741.

(30) Foreign Application Priority Data

Oct. 6, 1998 (JP) ..... 10-284492

(51) Int. Cl.
*G09G 3/20* (2006.01)

(52) U.S. Cl. ..... 345/75; 345/74.1; 345/75.2

(58) Field of Classification Search ..... 345/74.1–75.2, 345/60, 101, 87, 89, 84, 204, 102, 76, 11; 315/1, 205; 323/274; 313/495, 496; 348/14.01; 445/6

See application file for complete search history.

(56) References Cited

U.S. PATENT DOCUMENTS 4,680,511 A 7/1987 Fitzgerald et al. ..... 315/411
4,904,895 A 2/1990 Tsukomoto et al. ..... 313/336
5,047,698 A 9/1991 Fernsler et al. ..... 315/411
5,066,883 A 11/1991 Yoshioka et al. ..... 313/309
5,068,579 A 11/1991 Tomii et al. ..... 315/366
5,569,974 A 10/1996 Morikawa et al. ..... 313/310
5,578,906 A 11/1996 Smith ..... 315/169.3
5,659,329 A 8/1997 Yamanobe et al. ..... 345/74.1
5,682,085 A 10/1997 Suzuki et al. ..... 315/169.1

(Continued)

FOREIGN PATENT DOCUMENTS

JP 60-216387 4/1984

(Continued)

OTHER PUBLICATIONS

"Electrical Conduction And Electron Emission of Discontinuous Thin Films", G. Dittmer, Thin Film Solids, 9 (1972), pp. 317-328.

(Continued)

*Primary Examiner*—Bipin Shalwala
*Assistant Examiner*—Prabodh Dharia
(74) *Attorney, Agent, or Firm*—Fitzpatrick, Cella, Harper & Scinto

(57) ABSTRACT

This invention discloses an arrangement for suppressing an erroneous display and suppressing damage to an image display apparatus when a power source is turned on, the power source is turned off, an outlet is removed, or power fails. Particularly, this invention discloses an arrangement for stopping, for a predetermined time, input of a scanning signal or modulation signal to a display panel or application of an accelerating potential in turning on the power source. This invention discloses an arrangement for stopping input of a scanning signal or modulation signal to the display panel, and then stopping supply of power in turning off the power source.

6 Claims, 31 Drawing Sheets

U.S. PATENT DOCUMENTS

| | | | | |
|---|---|---|---|---|
| 5,721,560 | A | 2/1998 | Cathey, Jr. et al. | 345/74 |
| 5,751,925 | A * | 5/1998 | Kataoka et al. | 358/1.16 |
| 5,754,148 | A | 5/1998 | Kishino et al. | 345/74 |
| 5,856,814 | A * | 1/1999 | Yagyu | 345/89 |
| 6,064,125 | A * | 5/2000 | Stendardo et al. | 307/64 |
| 6,133,894 | A * | 10/2000 | Yagyu | 345/89 |
| 6,140,985 | A | 10/2000 | Kanai et al. | 345/74.1 |
| 6,219,113 | B1 * | 4/2001 | Takahara | 349/42 |
| 6,259,422 | B1 | 7/2001 | Hamamoto | 345/74.1 |
| 6,270,389 | B1 | 8/2001 | Kobayashi et al. | 445/24 |
| 6,288,485 | B1 * | 9/2001 | Takegami et al. | 313/495 |
| 6,323,851 | B1 | 11/2001 | Nakanishi | 345/211 |
| 6,333,750 | B1 * | 12/2001 | Odryna et al. | 345/629 |
| 6,404,135 | B1 * | 6/2002 | Shino | 315/169.1 |
| 6,445,367 | B1 | 9/2002 | Suzuki et al. | 345/75.2 |
| 6,485,703 | B1 * | 11/2002 | Cote et al. | 424/9.1 |
| 6,514,559 | B1 | 2/2003 | Miyamoto et al. | 427/78 |
| 6,603,450 | B1 * | 8/2003 | Yamazaki et al. | 345/75.2 |
| 6,635,985 | B2 * | 10/2003 | Beeteson et al. | 313/495 |
| 6,707,437 | B1 * | 3/2004 | Kuno et al. | 345/74.1 |
| 6,809,480 | B2 * | 10/2004 | Shino | 315/169.1 |
| 6,847,337 | B2 * | 1/2005 | Ichikawa | 345/11 |
| 2001/0013603 | A1 | 8/2001 | Mitsutake et al. | 257/10 |
| 2002/0021292 | A1 * | 2/2002 | Sakashita | 345/204 |
| 2002/0074934 | A1 * | 6/2002 | Beeteson et al. | 313/495 |
| 2002/0101180 | A1 * | 8/2002 | Shino | 315/169.3 |
| 2003/0006946 | A1 * | 1/2003 | Ichikawa | 345/74.1 |
| 2003/0117420 | A1 | 6/2003 | Ando et al. | 345/690 |
| 2004/0070331 | A1 * | 4/2004 | Kuno et al. | 313/495 |

FOREIGN PATENT DOCUMENTS

| | | |
|---|---|---|
| JP | 60-216387 | 10/1985 |
| JP | 62-206589 | 9/1987 |
| JP | 63-304228 | 12/1988 |
| JP | 1031332 | 2/1989 |
| JP | 02272490 | 7/1990 |
| JP | 02273720 | 8/1990 |
| JP | 2257551 | 10/1990 |
| JP | 03048889 | 1/1991 |
| JP | 3055738 | 3/1991 |
| JP | 4028137 | 1/1992 |
| JP | 04204993 A | 7/1992 |
| JP | 4-107293 | 9/1992 |
| JP | 07-235255 | 5/1995 |
| JP | 10-172479 | 6/1998 |
| JP | 11-167366 | 6/1999 |
| KR | 1997-0031143 | 6/1997 |
| WO | WO96/15519 | 5/1996 |

OTHER PUBLICATIONS

"Electroforming and Electron Emission of Carbon Thin Films", Hisashi Asaki et al., Vacuum, vol. 26, No. 1, pp. 22-29 (1983).

"Strong Election Emission From Patterned Tin-Indium Oxide Thin Films", M. Hartwell et al., International Electron Devices Meeting, Washington DC (1975) pp. 519-521.

"The Emission of Hot Electrons and The Field Emission of Electrons From Tin Oxide", M. I. Elinson et al., Radio Engineering and Electronic Physics, Jul. 1965, pp. 1290-1296.

"Field Emission", W.P. Dyke et al., Advances in Electronics and Electron Physics, (1956), pp. 89-185.

"Physical Properties of Thin-Film Field Emission Cathodes With Molybedium Cones", J. Appl. Phys., 47,5248 (1976), pp. 5248-5263.

"Operation of Tunnel-Emission Devices", C.A. Mead, Appl. Phys., vol. 32, No. e, Apr. 1961, pp. 646-652.

R. Meyer, "Recent Development on "Microtips" Display at LETI," Technical Digest of 4th Int. Vacuum Microelectronics Conf., Nagahama (1991), pp. 6-9.

* cited by examiner

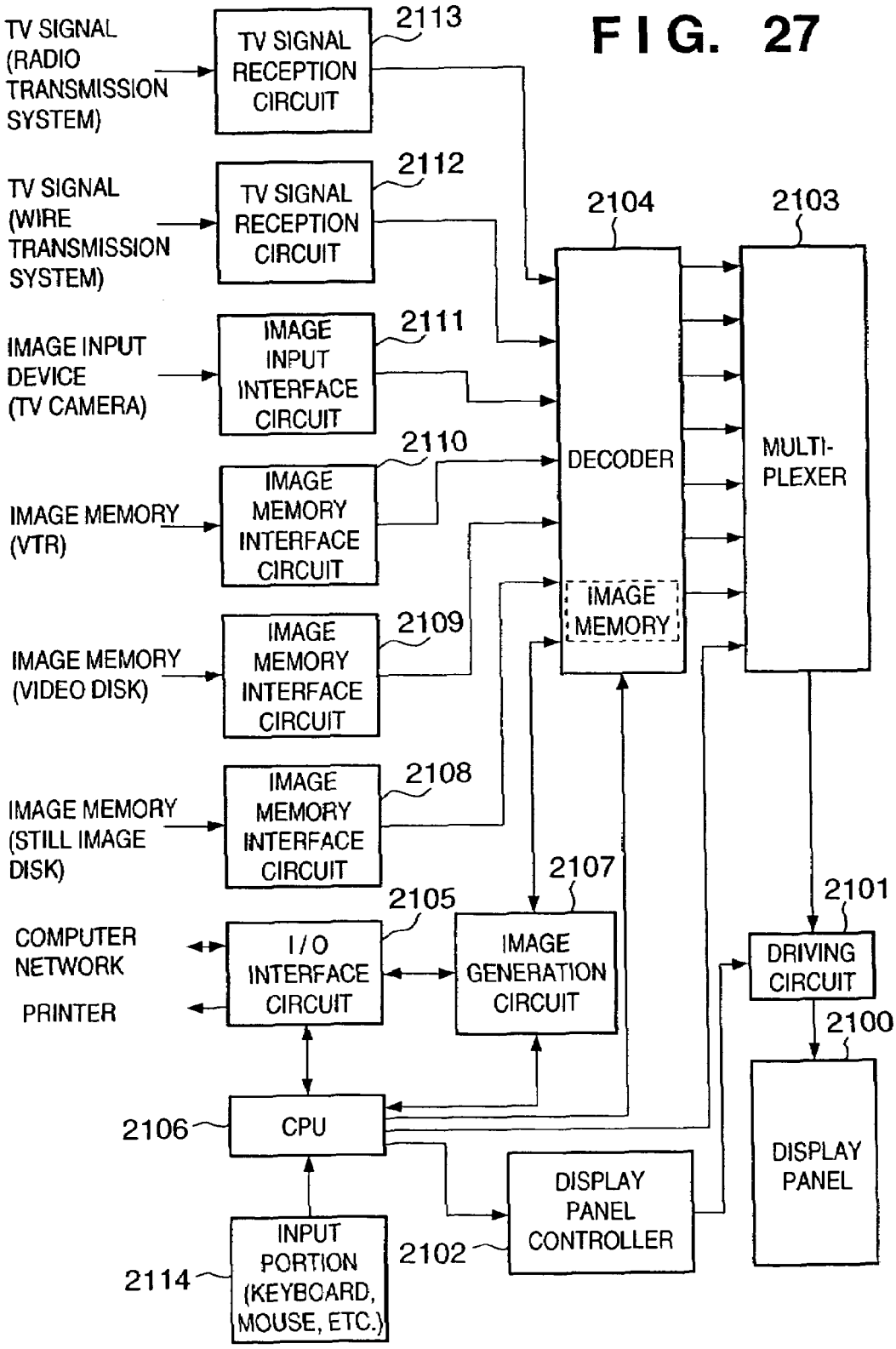
FIG. 27
TV SIGNAL (RADIO TRANSMISSION SYSTEM)
TV SIGNAL RECEPTION CIRCUIT
2113
TV SIGNAL (WIRE TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE MEMORY INTERFACE CIRCUIT
2110
IMAGE MEMORY (VIDEO DISK)
IMAGE MEMORY INTERFACE CIRCUIT
2109
IMAGE MEMORY (STILL IMAGE DISK)
IMAGE MEMORY INTERFACE CIRCUIT
2108
2104
DECODER
IMAGE MEMORY
2103
MULTI-PLEXER
2107
IMAGE GENERATION CIRCUIT
2105
COMPUTER NETWORK
PRINTER
I/O INTERFACE CIRCUIT
2101
DRIVING CIRCUIT
2100
DISPLAY PANEL
2106
CPU
DISPLAY PANEL CONTROLLER
2102
2114
INPUT PORTION (KEYBOARD, MOUSE, ETC.)

METHOD OF CONTROLLING IMAGE DISPLAY

This application is a division of U.S. application Ser. No. 09/719,523, now U.S. Pat. No. 6,972,741 which is a National Stage application under 35 U.S.C. §371 of International Application No. PCT/JP99/05473, filed Oct. 5, 1999, published in Japanese (but not in English) as WO 0021063.

TECHNICAL FIELD

The present invention relates to an image display apparatus control method and, more particularly, to a power-on/off control method and emergency shutdown control method for an image display apparatus using an image display panel having a multi electron source on which a plurality of cold cathode devices are wired in a matrix, and fluorescent substances for emitting light upon irradiation with an electron beam from each cold cathode device.

BACKGROUND ART

Conventionally, two types of devices, namely a thermionic cathode device and cold cathode device, are known as electron-emitting devices. Known examples of the cold cathode devices are surface-conduction type emitting devices, field emission type emitting devices (to be referred to as FE type emitting devices hereinafter), and metal/insulator/metal type emitting devices (to be referred to as MIM type emitting devices hereinafter).

As surface-conduction type emitting devices, e.g., M. I. Elinson, Radio Eng. Electron Phys., 10, 1290 (1965) and other examples (to be described later) are known.

The surface-conduction type emitting device utilizes the phenomenon that electrons are emitted by flowing a current through a small-area thin film formed on a substrate in parallel with the film surface. The surface-conduction type emitting device includes an emitting device using an Au thin film [G. Dittmer, "Thin Solid Films", 9, 317 (1972)], an emitting device using an $In_2O_3/SnO_2$ thin film [M. Hartwell and C. G. Fonstad, "IEEE Trans. ED Conf.", 519 (1975)], an emitting device using a carbon thin film [Hisashi Araki et al., "Vacuum", Vol. 26, No. 1, p. 22 (1983)], and the like, in addition to an emitting device using an $SnO_2$ thin film by Elinson et al.

FIG. 28 is a plan view showing the device by M. Hartwell et al. described above as a typical example of the device structures of these surface-conduction type emitting devices. In FIG. 28, reference numeral 3001 denotes a substrate; and 3004, a conductive thin film made of a metal oxide formed by sputtering. The conductive thin film 3004 has an H-shaped flat pattern, as shown in FIG. 28. The conductive thin film 3004 undergoes electrification processing (to be referred to as forming processing), thereby forming an electron-emitting portion 3005. An interval L in FIG. 28 is set to 0.5 to 1 [mm], and W is set to 0.1 [mm]. The electron-emitting portion 3005 is illustrated in a rectangular shape at the center of the conductive thin film 3004 for the sake of illustrative convenience. However, this does not exactly show the actual position and shape of the electron-emitting portion.

In the above surface-conduction type emitting devices by M. Hartwell et al. and the like, typically the electron-emitting portion 3005 is formed by performing electrification processing called forming processing for the conductive thin film 3004 before electron emission. In electrification forming, a constant DC voltage or a DC voltage which rises at a very low rate of, e.g., about 1 V/min is applied across the conductive thin film 3004 to locally destroy, deform or denature the conductive thin film 3004, thereby forming the electron-emitting portion 3005 with an electrically high resistance. Note that the locally destroyed, deformed or denatured part of the conductive thin film 3004 has a fissure. When an appropriate voltage is applied to the conductive thin film 3004 after electrification forming, electrons are emitted near the fissure.

Known examples of the FE type devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 29 is a sectional view showing the device by C. A. Spindt et al. described above as a typical example of the FE type device structure. In FIG. 29, reference numeral 3010 denotes a substrate; 3011, an emitter wiring line made of a conductive material; 3012, an emitter cone; 3013, an insulating layer; and 3014, a gate electrode. This device is caused to produce a field emission from the tip of the emitter cone 3012 by applying an appropriate voltage between the emitter cone 3012 and the gate electrode 3014.

As another FE type device structure, there is an example in which an emitter and gate electrode are arranged on a substrate to be almost parallel to the substrate surface, instead of the multilayered structure of FIG. 29.

A known example of the MIM type emitting devices is described in C. A. Mead, "Operation of tunnel-emission Devices, J. Appl. Phys., 32, 646 (1961).

FIG. 30 shows a typical example of the MIM type device structure. FIG. 30 is a sectional view. Reference numeral 3020 denotes a substrate; 3021, a lower metal electrode; 3022, a thin insulating layer having a thickness of about 100 Å; and 3023, an upper metal electrode having a thickness of about 80 to 300 Å. The MIM type emitting device emits electrons from the surface of the upper electrode 3023 by applying an appropriate voltage between the upper electrode 3023 and the lower electrode 3021.

Since these cold cathode devices can emit electrons at a lower temperature, compared to the thermionic cathode devices, the cold cathode devices do not require any heater. The cold cathode device has a structure simpler than that of the thermionic cathode device, and it is possible to fabricate elements that are finer. Even if many devices are arranged on a substrate at a high density, problems such as heat fusion of the substrate hardly arise. In addition, the response speed of the cold cathode device is high, while the response speed of the thermionic cathode device is low because it operates upon heating by a heater.

For this reason, applications of the cold cathode devices have enthusiastically been studied.

Of cold cathode devices, the surface-conduction type emitting device has a simple structure and can be easily manufactured to allow forming many devices on a wide area. As disclosed in Japanese Patent Laid-Open No. 64-31332 filed by the present applicant, a method of arranging and driving many devices has been studied.

Regarding applications of the surface-conduction type emitting devices to, e.g., image forming apparatuses such as image display apparatuses and image recording apparatuses, charge beam sources, and the like have been studied.

Particularly as an application to image display apparatuses, as disclosed in the U.S. Pat. No. 5,066,883 and Japanese Patent Laid-Open Nos. 2-257551 and 4-2813.7 filed by the present applicant, an image display apparatus using a combination of surface-conduction type emitting devices and fluorescent substances which emit light upon irradiation with an electron beam has been studied. This type of image display apparatus using a combination of surface-conduction type emitting devices and fluorescent substances is expected to exhibit more excellent characteristics than other conventional image display apparatuses. For example, compared with recent popular liquid crystal display apparatuses, the above display apparatus is superior in that it does not require any backlight because of a self-emission type and that it has a wide view angle.

A method of driving many FE type emitting devices arranged side by side is disclosed in, e.g., U.S. Pat. No. 4,904,895 filed by the present applicant. As a known example of an application of FE type emitting devices to an image display apparatus is a flat display apparatus reported by R. Meyer et al. [R. Meyer: "Recent Development on Microtips Display at LETI", Tech. Digest of 4th Int. Vacuum Microele-ctronics Conf., Nagahama, pp. 6-9 (1991)].

An example of an application of many MIM type emitting devices arranged side by side to an image display apparatus is disclosed in Japanese Patent Laid-Open No. 3-55738 filed by the present applicant.

The present inventors have examined cold cathode devices of various materials, manufacturing methods, and structures, in addition to the prior arts. Further, the present inventors have made extensive studies on a multi electron beam source having many cold cathode devices, and an image display apparatus using this multi electron beam source.

FIG. 31 shows a multi electron beam source by an electrical wiring method examined by the present inventors. More specifically, this multi electron beam source is constituted by two-dimensionally arranging many cold cathode devices, and wiring these devices in a matrix, as shown in FIG. 31. In FIG. 31, reference numeral 4001 denotes a schematic cold cathode device; 4002, a row-direction wiring line; and 4003, a column-direction wiring line. In practice, the row-direction wiring line 4002 and column-direction wiring line 4003 have finite electrical resistances, which are represented as wiring resistances 4004 and 4005 in FIG. 31. This wiring method is called a simple matrix wiring method.

For the illustrative convenience, the multi electron beam source is illustrated in a 6×6 matrix, but the size of the matrix is not limited to this. For example, in a multi electron beam source for an image display apparatus, devices enough to display a desired image are arranged and wired.

In a multi electron beam source in which cold cathode devices are wired in a simple matrix, appropriate electrical signals are applied to the row-direction wiring line 4002 and column-direction wiring line 4003 in order to output a desired electron beam. For example, to drive cold cathode devices on an arbitrary row in the matrix, a selection voltage Vs is applied to the row-direction wiring line 4002 on the row to be selected, and at the same time a non-selection voltage Vns is applied to the row-direction wiring lines 4002 on unselected rows. In synchronism with this, a driving voltage Ve for outputting an electron beam is applied to the column-direction wiring lines 4003. According to this method, so long as voltage drops across the wiring resistances 4004 and 4005 are neglected, a voltage Ve-Vs is applied to cold cathode devices on the selected row, and a voltage Ve-Vns is applied to cold cathode devices on the unselected rows. If the voltages Ve, Vs, and Vns are set to appropriate levels, an electron beam having a desired intensity must be output from only cold cathode devices on the selected row. If different driving voltages Ve are applied to respective column-direction wiring lines, electron beams having different intensities must be output from respective devices on the selected row. If the application time of the driving voltage Ve is changed, the electron beam output time must be changed.

Hence, a multi electron beam source having cold cathode devices wired in a simple matrix can be applied for variety purposes. For example, if an electrical signal corresponding to image information is properly applied, the multi electron beam source can be preferably used as an electron source for an image display apparatus.

In practice, however, the multi electron beam source having cold cathode devices wired in a simple matrix suffers the following problems.

When the power source of the image display apparatus is turned on, before outputs to be applied from voltage power sources to row-direction wiring lines and column-direction wiring lines stabilize, the outputs from the power sources are applied to the multi electron beam source to damage cold cathode devices.

The same phenomenon occurs when the power source is turned off.

When the potential difference between an acceleration potential for accelerating electrons from the electron source and a potential supplied to the electron source in order to emit electrons is large, and particularly when the potential difference between the electron emission potential and the acceleration potential is 500 V or more, 3 kv or more, or 5 kV or more, an unexpected power source operation may occur while a high acceleration potential is applied. In this case, a discomfort display state may be generated, or the performance of the display panel such as the characteristics of the fluorescent substance may be influenced.

It is an object of an invention according to the present application to improve the display state and reduce damage to the image display apparatus when a power source is turned on, the power source is turned off, an outlet is removed, or power fails.

DISCLOSURE OF INVENTION

According to one invention of the present application, an image display apparatus control method is characterized by comprising, when image display is to be started by outputting a signal from a modulation circuit to a display panel for displaying an image by irradiation with electrons from an electron source to fluorescent substances, stopping the output from the modulation circuit to the display panel until the signal output from the modulation circuit to the display panel is determined.

According to another invention of the present application, an image display apparatus control method is characterized by comprising, when image display is to be started by outputting a signal from a modulation circuit to a display panel for displaying an image by irradiation with electrons from an electron source to fluorescent substances, delaying the output of the signal from the modulation circuit to the display panel after a power source is turned on, and determining the signal output from the modulation circuit to the display panel during the delay time.

According to still another invention of the present application, an image display apparatus control method is characterized by comprising, when image display is to be started by outputting a signal from a modulation circuit to a display panel for displaying an image by irradiation with electrons from an electron source to fluorescent substances, stopping application of an acceleration potential for accelerating electrons from the electron source until the signal output from the modulation circuit to the display panel is determined.

According to still another invention of the present application, an image display apparatus control method is characterized by comprising, when image display is to be started by outputting a signal from a modulation circuit to a display panel for displaying an image by irradiation with electrons from an electron source to fluorescent substances, delaying application of an acceleration potential for accelerating electrons from the electron source after a power source is turned on, and determining the signal output from the modulation circuit to the display panel during the delay time.

According to still another invention of the present application, an image display apparatus control method is characterized by comprising, when image display is to be started by outputting a signal from a scanning circuit to a display panel for displaying an image by irradiation with electrons from an electron source to fluorescent substances, stopping the output from the scanning circuit to the display panel until the signal output from the scanning circuit to the display panel is determined.

According to still another invention of the present application, an image display apparatus control method is characterized by comprising, when image display is to be started by outputting a signal from a scanning circuit to a display panel for displaying an image by irradiation with electrons from an electron source to fluorescent substances, delaying the output of the signal from the scanning circuit to the display panel after a power source is turned on, and determining the signal output from the scanning circuit to the display panel during the delay time.

According to still another invention of the present application, an image display apparatus control method is characterized by comprising, when image display is to be started by outputting a signal from a scanning circuit to a display panel for displaying an image by irradiation with electrons from an electron source to fluorescent substances, stopping application of an acceleration potential for accelerating electrons from the electron source until the signal output from the scanning circuit to the display panel is determined.

According to still another invention of the present application, an image display apparatus control method is characterized by comprising, when image display is to be started by outputting a signal from a scanning circuit to a display panel for displaying an image by irradiation with electrons from an electron source to fluorescent substances, delaying application of an acceleration potential for accelerating electrons from the electron source after a power source is turned on, and determining the signal output from the scanning circuit to the display panel during the delay time.

According to still another invention of the present application, an image display apparatus control method is characterized by comprising, when image display is to be started by outputting a signal from a modulation circuit to a display panel for displaying an image by irradiation with electrons from an electron source to fluorescent substances, stopping the output from the modulation circuit to the display panel until a power source voltage of the modulation circuit reaches a desired value.

According to still another invention of the present application, an image display apparatus control method is characterized by comprising, when image display is to be started by outputting a signal from a modulation circuit to a display panel for displaying an image by irradiation with electrons from an electron source to fluorescent substances, delaying the output of the signal from the modulation circuit to the display panel after a power source is turned on, and setting a power source voltage of the modulation circuit to a desired value during the delay time.

According to still another invention of the present application, an image display apparatus control method is characterized by comprising, when image display is to be started by outputting a signal from a modulation circuit to a display panel for displaying an image by irradiation with electrons from an electron source to fluorescent substances, stopping application of an acceleration potential for accelerating electrons from the electron source until a power source voltage of the modulation circuit reaches a desired value.

According to still another invention of the present application, an image display apparatus control method is characterized by comprising, when image display is to be started by outputting a signal from a modulation circuit to a display panel for displaying an image by irradiation with electrons from an electron source to fluorescent substances, delaying application of an acceleration potential for accelerating electrons from the electron Source after a power source is turned on, and setting a power source voltage of the modulation circuit to a desired value during the delay time.

According to still another invention of the present application, an image display apparatus control method is characterized by comprising, when image display is to be started by outputting a signal from a scanning circuit to a display panel for displaying an image by irradiation with electrons from an electron source to fluorescent substances, stopping the output from the scanning circuit to the display panel until a power source voltage of the scanning circuit reaches a desired value.

According to still another invention of the present application, an image display apparatus control method is characterized by comprising, when image display is to be started by outputting a signal from a scanning circuit to a display panel for displaying an image by irradiation with electrons from an electron source to fluorescent substances, delaying the output of the signal from the scanning circuit to the display panel after a power source is turned on, and setting a power source voltage of the scanning circuit to a desired value during the delay time.

According to still another invention of the present application, an image display apparatus control method is characterized by comprising, when image display is to be started by outputting a signal from a scanning circuit to a display panel for displaying an image by irradiation with electrons from an electron source to fluorescent substances, stopping application of an acceleration potential for accelerating electrons from the electron source until a power source voltage of the scanning circuit reaches a desired value.

According to still another invention of the present application, an image display apparatus control method is characterized by comprising, when image display is to be started by outputting a signal from a scanning circuit to a display panel for displaying an image by irradiation with electrons from an electron source to fluorescent substances, delaying application of an acceleration potential for accelerating electrons from the electron source after a power source is turned on, and setting a power source voltage of the scanning circuit to a desired value during the delay time.

According to still another invention of the present application, an image display apparatus control method is characterized by comprising, when a power source is to be turned off while an image is displayed by outputting a signal from a modulation circuit to a display panel for displaying an image by irradiation with electrons from an electron source to fluorescent substances, stopping the output of the signal from the modulation circuit to the display panel, and then stopping supply of power to the modulation circuit.

According to still another invention of the present application, an image display apparatus control method is characterized by comprising, when a power source is to be turned off while an image is displayed by outputting a signal from a scanning circuit to a display panel for displaying an image by irradiation with electrons from an electron source to fluorescent substances, stopping the output of the signal from the scanning circuit to the display panel, and then stopping supply of power to the scanning circuit.

According to still another invention of the present application, an image display apparatus control method is characterized by comprising, when emergency shutdown is to be performed while an image is displayed by outputting a signal from a modulation circuit to a display panel for displaying an image by irradiation with electrons from an electron source to fluorescent substances, stopping the output of the signal from the modulation circuit to the display panel, and then stopping supply of power to the modulation circuit.

According to still another invention of the present application, an image display apparatus control method is characterized by comprising, when emergency shutdown is to be performed while an image is displayed by outputting a signal from a scanning circuit to a display panel for displaying an image by irradiation with electrons from an electron source to fluorescent substances, stopping the output of the signal from the scanning circuit to the display panel, and then stopping supply of power to the scanning circuit.

According to still another invention of the present application, an image display apparatus control method is characterized by comprising, when a voltage abnormality is observed while an image is displayed by outputting a signal from a modulation circuit to a display panel for displaying an image by irradiation with electrons from an electron source to fluorescent substances, stopping the output of the signal from the modulation circuit to the display panel, and then stopping supply of power to the modulation circuit.

According to still another invention of the present application, an image display apparatus control method is characterized by comprising, when a voltage abnormality is observed while an image is displayed by outputting a signal from a scanning circuit to a display panel for displaying an image by irradiation with electrons from an electron source to fluorescent substances, stopping the output of the signal from the scanning circuit to the display panel, and then stopping supply of power to the scanning circuit.

The power is preferably supplied from an auxiliary power source in performing control when the voltage abnormality is observed.

In each of the above-described inventions, a time during which the signal output to the display panel is stopped, or a time during which application of the acceleration potential is stopped, or the delay time is a predetermined time. The predetermined time is selected by counting a predetermined number of sync signals, or obtained by counting the predetermined time with a timer.

Each invention can be preferably employed especially when the electron source comprises a plurality of row-direction wiring lines for receiving a scanning signal, a plurality of column-direction wiring lines for receiving a modulation signal, and a plurality of electron-emitting devices connected to the row-direction wiring lines and the column-direction wiring lines.

Each invention can be preferably employed especially when the acceleration potential for accelerating electrons from the electron source is a potential higher by not less than 500 V than a potential applied to emit electrons in the electron source. In this case, the potential applied to emit electrons in the electron source is, e.g., a potential applied to an electron-emitting portion. For example, in an electron-emitting device which receives a potential difference between electrodes to emit electrons, the potential applied to emit electrons is a lower potential applied to the one of the electrodes which receive the potential difference.

According to still another invention of the present application, an image display apparatus is characterized by comprising a display panel for displaying an image by irradiation with electrons from an electron source to fluorescent substances, a scanning circuit for supplying a scanning signal to the display panel, a modulation circuit for supplying a modulation signal to the display panel, and a control circuit for stopping output from the scanning circuit and/or the modulation circuit to the display panel until a signal output from the scanning circuit and/or the modulation circuit to the display panel is determined in starting image display by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, a scanning circuit for supplying a scanning signal to the display panel, a modulation circuit for supplying a modulation signal to the display panel, and a control circuit for delaying output of a signal from the scanning circuit and/or the modulation circuit to the display panel after a power source is turned on in starting image display by outputting a signal from the scanning circuit and/or the modulation circuit to the display panel, wherein the signal output from the scanning circuit and/or the modulation circuit to the display panel is determined during the delay time.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for stopping supply of the acceleration potential until a signal output from the scanning circuit and/or the modulation circuit to the display panel is determined in starting image display by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for delaying supply of the acceleration potential after a power source is turned on in starting image display by outputting a signal from the scanning circuit and/or the modulation circuit to the display panel, wherein the signal output from the scanning circuit and/or the modulation circuit to the display panel is determined during the delay time.

According to still another invention of the present application, an image display apparatus is characterized by comprising a display panel for displaying an image by irradiation with electrons from an electron source to fluorescent substances, a scanning circuit for supplying a scanning signal to the display panel, a modulation circuit for supplying a modulation signal to the display panel, and a control circuit for stopping output from the scanning circuit and/or the modulation circuit to the display panel until a power source voltage of the scanning circuit and/or the modulation circuit reaches a desired value in starting image display by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, a scanning circuit for supplying a scanning signal to the display panel, a modulation circuit for supplying a modulation signal to the display panel, and a control circuit for delaying output of a signal from the scanning circuit and/or the modulation circuit to the display panel after a power source is turned on in starting image display by outputting a signal from the scanning circuit and/or the modulation circuit to the display panel, wherein a power source voltage of the scanning circuit and/or the modulation circuit reaches a desired value during the delay time.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for stopping supply of the acceleration potential until a power source voltage of the scanning circuit and/or the modulation circuit reaches a desired value in starting image display by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for delaying supply of the acceleration potential after a power source is turned on in starting image display by outputting a signal from the scanning circuit and/or the modulation circuit to the display panel, wherein a power source voltage of the scanning circuit and/or the modulation circuit reaches a desired value during the delay time.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for stopping output of a signal from the scanning circuit and/or the modulation circuit to the display panel, and then stopping supply of power to the scanning circuit and/or the modulation circuit in turning off a power source while an image is displayed by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for stopping output of a signal from the scanning circuit and/or the modulation circuit to the display panel, and then stopping supply of power to the scanning circuit and/or the modulation circuit in performing emergency shutdown while an image is displayed by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, and a control circuit for stopping output of a signal from the scanning circuit and/or the modulation circuit to the display panel, and then stopping supply of power to the scanning circuit and/or the modulation circuit when a voltage abnormality is observed while an image is displayed by outputting a signal from the scanning circuit and/or the modulation circuit to the display panel.

According to still another invention of the present application, an image display apparatus is characterized by comprising a display panel for displaying an image by irradiation with electrons from an electron source to fluorescent substances, an acceleration potential supply circuit for supplying to the display panel an acceleration potential for accelerating electrons from the electron source, a scanning circuit for supplying a scanning signal to the display panel, a modulation circuit for supplying a modulation signal to the display panel, a first power source for supplying power to the acceleration potential supply circuit and/or the scanning circuit and/or the modulation circuit, and a second power source for supplying power to the scanning circuit and/or the modulation circuit upon an abnormal state. In this case, the abnormal state is emergency shutdown, and the second power source comprises a capacitor or a battery.

Each of the above-described inventions does not exclude an arrangement in which the scanning circuit and/or the modulation circuit and/or the acceleration potential supply circuit also serves as the control circuit.

BRIEF DESCRIPTION OF DRAWINGS

FIG. 27 is a block diagram showing a multifunctional display panel;

DETAILED DESCRIPTION OF THE PREFERRED EMBODIMENTS

The best mode for carrying out the present invention will be described with reference to the accompanying drawings.

First Embodiment

Figure 1:
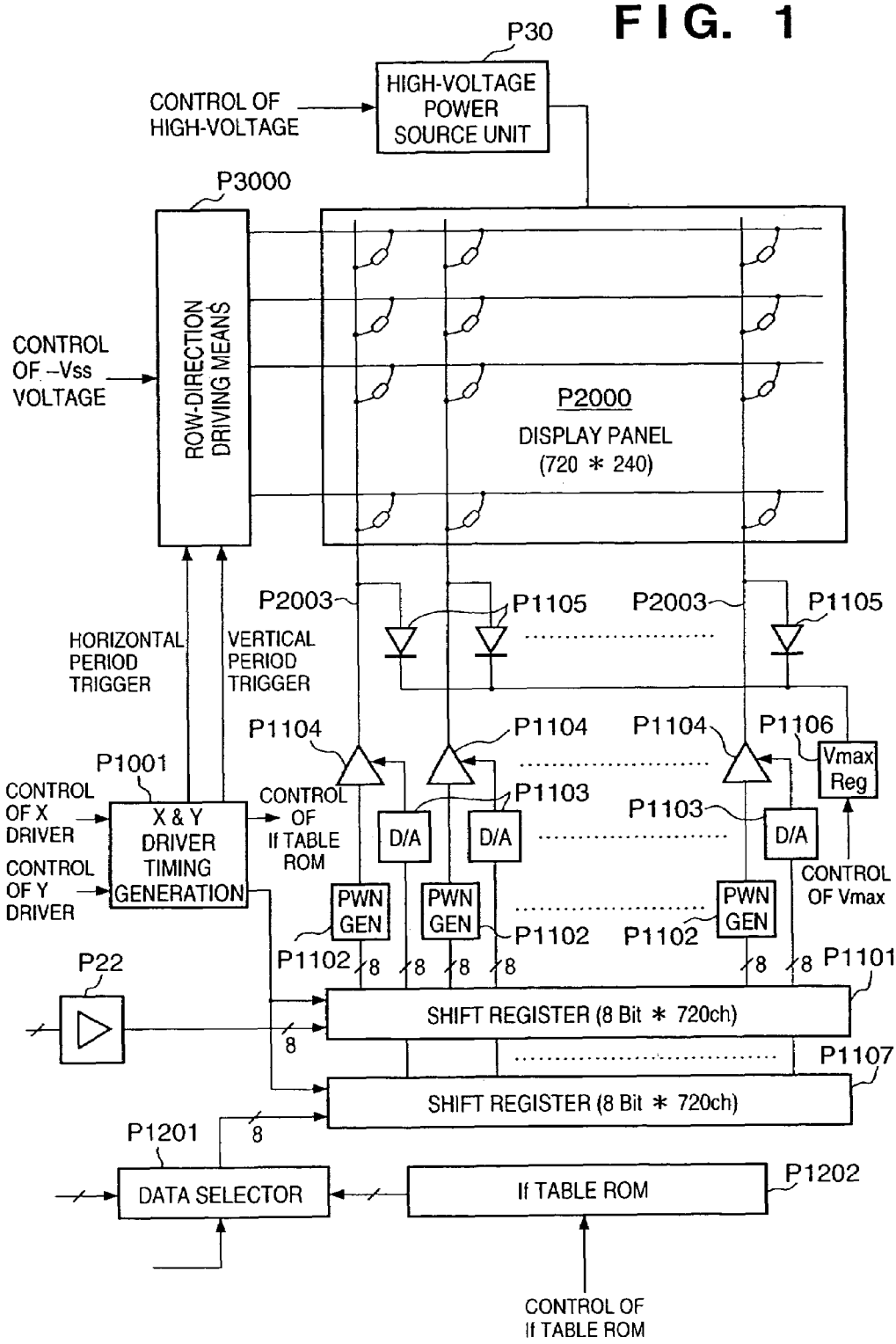
FIG. 1 is a block diagram showing the driving circuit of an image display apparatus.

FIG. 1 is a block diagram showing a driving circuit for an SED (Surface Electron emitter Display) panel according to this embodiment.

Reference symbol P2000 denotes a display panel. In this embodiment, the display panel P2000 is constituted by arranging 240*720 surface-conduction type devices; P2001 in a matrix by row wiring lines of 240 vertical rows and column wiring lines of 720 horizontal columns. An electron beam emitted by each surface-conduction type device; P2001 is accelerated by a high voltage applied from a high-voltage power source unit; P30 to irradiate fluorescent substances (not shown), thereby emitting light. The fluorescent substance (not shown) can take various color layouts in accordance with application purposes. For example, the fluorescent substance takes a vertically striped color layout of R, G, and B colors.

This embodiment will exemplify an application of displaying an NTSC television image on a display panel having pixels of 240 horizontal (R, G, and B trio)* 240 vertical lines. Almost the same arrangement can cope with not only the NTSC image but also image signals having different resolutions and frame rates, such as a high-resolution HDTV image and computer output image.

The driving circuit for the SED (Surface Electron emitter Display) panel is constituted by a video circuit unit, system control unit, and driving circuit unit.

Figure 2:
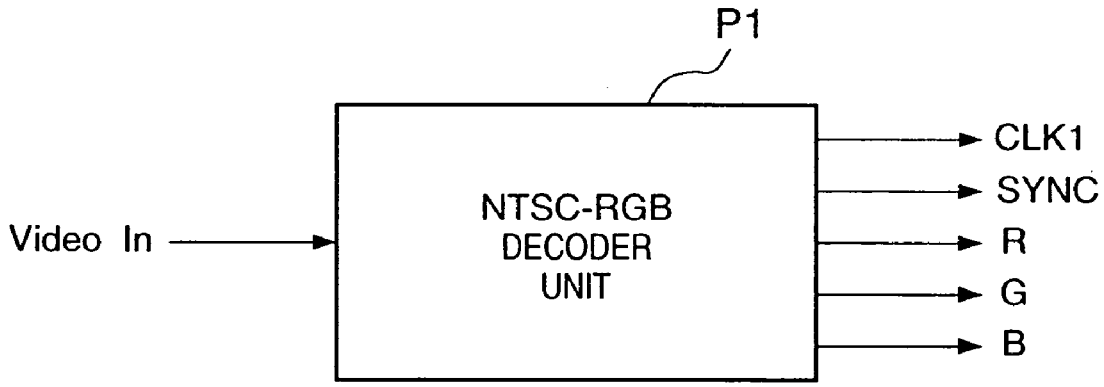
FIG. 2 is a block diagram showing an NTSC-RGB decoder unit.

Reference symbol P1 shown in FIG. 2 denotes an NTSC-RGB decoder unit for receiving an NTSC composite video input and outputting R, G, and B components. This unit separates and outputs a sync signal (SYNC) superposed on an input video signal. Similarly, the unit separates a color burst signal superposed on the input video signal, and generates and outputs a CLK signal (CLK1) which synchronizes with the color burst signal.

Figure 3:
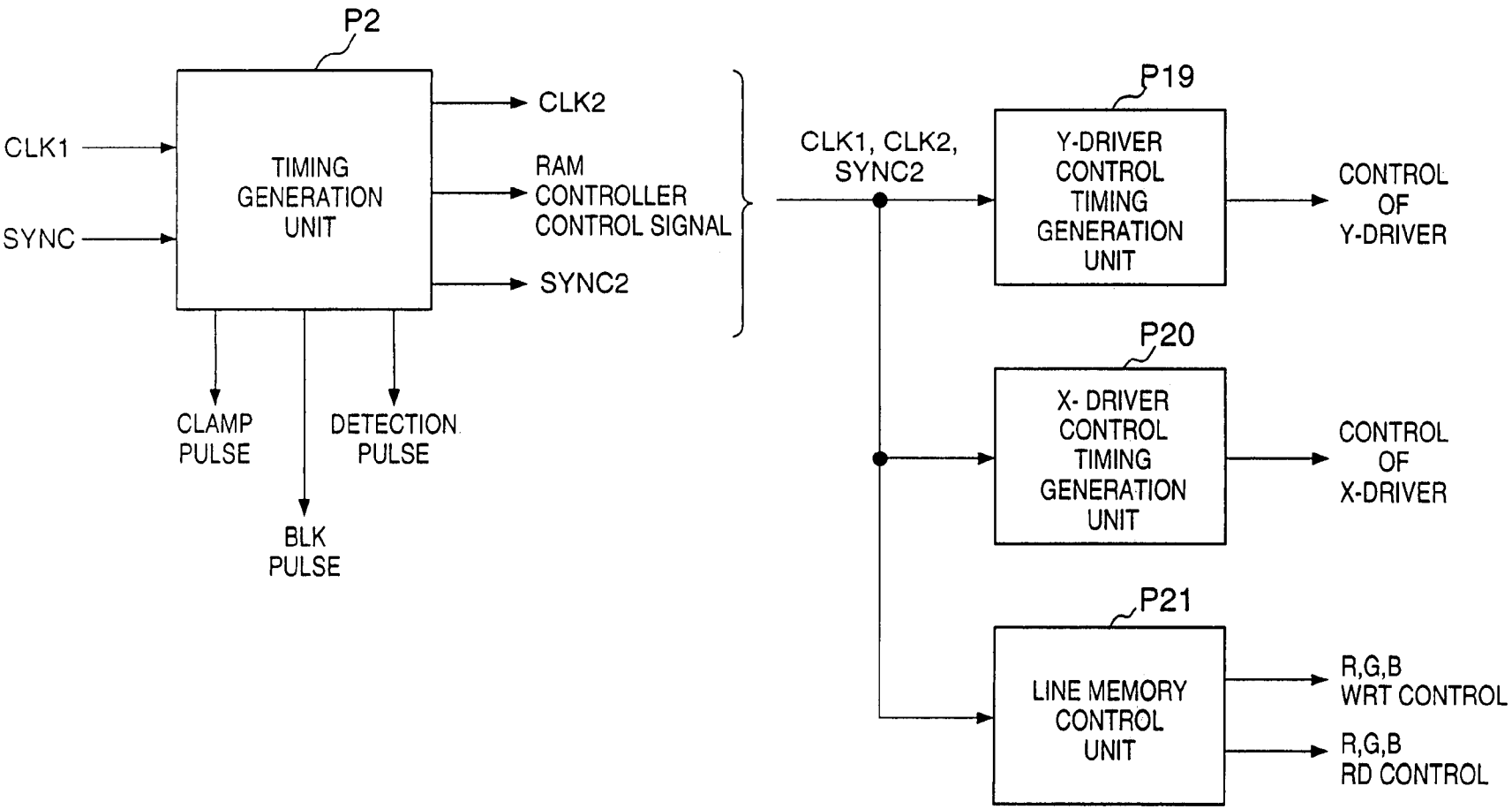
FIG. 3 is a block diagram showing an analog processing unit.

Reference symbol P2 shown in FIG. 3 denotes a timing generation unit for generating timing signals necessary for converting analog R, G, and B signals decoded by P1 into digital tone level signals for modulating the luminance of the SED panel. This timing signal includes a clamp pulse for DC-regenerating R, G, and B analog signals from P1 by analog processing units; P3, a blanking pulse (BLK pulse) for adding blanking periods to the R, G, and B analog signals from P1 by the analog processing units; P3, a detection pulse for detecting the levels of the R, G, and B analog signals by video detection units; P4, a sample pulse (not shown) for converting the analog R, G, and B signals into digital signals by A/D units; P6, a RAM controller control signal necessary for a RAM controller; P12 to control RAMs; P8, a free-running CLK signal (CLK2) which is generated in P2 and synchronizes with CLK1 from the internal PLL circuit of P2 when P2 receives CLK1, and a sync signal (SYNC2) generated in P2 based on CLK2. The timing generation unit; P2 having the free-running CLK2 generation means can generate CLK2 and SYNC2 serving as reference signals even when no input video signal exists, and thus an image can be displayed by reading out image data in the RAM means; P8.

Figure 4:
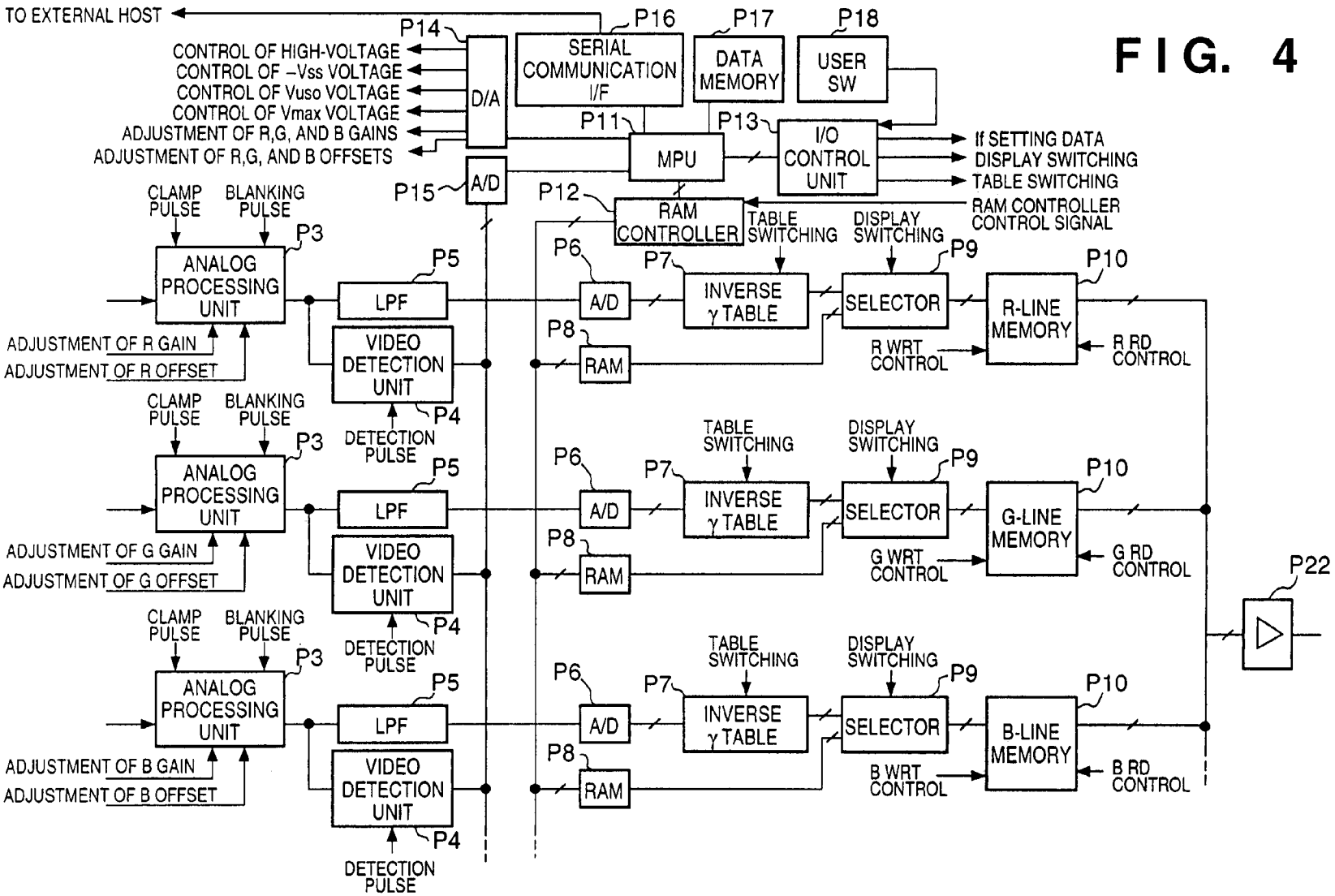
FIG. 4 is a block diagram showing another arrangement of the first embodiment.

P3 shown in FIG. 4 is the analog processing units disposed for respective primary color signals from P1. The analog processing unit P3 mainly performs the following operation. The analog processing unit P3 receives a clamp pulse from P2, and performs DC regeneration. P3 receives a BLK pulse from P2, and adds a blanking period. P3 receives a gain adjustment signal from a corresponding D/A unit; P14 serving as one of control outputs of a system control unit mainly made up of a MPU; P11, and controls the amplitude of a primary color signal input from P1. P3 receives an offset adjustment signal from the D/A unit; P14 serving as one of control outputs of the system control unit mainly made up of the MPU; P11, and controls the black level of a primary color signal input from P1.

Reference numerals P4 denote the video detection units for detecting input video signal levels or image signal levels after control by the analog processing units; P3. Each P4 receives a detection pulse from P2, and the detection result is read by a corresponding A/D unit; P15 serving as one of control inputs of the system control unit mainly made up of the MPU; P11.

The detection pulse from P2 is formed from, e.g., three, gate pulse, reset pulse, and sample & hold (to be referred to as S/H hereinafter) pulse. The video detection unit is comprised of, e.g., an integrating circuit and S/H circuit.

For example, the integrating circuit integrates a video signal in accordance with a gate pulse during the effective period of an input video signal, and the S/H circuit samples an output from the integrating circuit in accordance with an S/H pulse generated during a vertical blanking period. The detection result is read by the A/D unit; P15 during this vertical blanking period, and then the integrating circuit and S/H circuit are initialized by a reset pulse.

This operation enables detecting the average video level of each field.

Each FPE; P5 is a pre-filter means arranged on the input stage of a corresponding A/D unit; P6.

The A/D unit; P6 is an A/D converter means for receiving a sample CLK from P2 and quantizing an analog primary color signal having passed through the LPF; P5 by a necessary number of tone levels.

Each inverse γ table; P7 is a tone level characteristic conversion means adopted to convert an input video signal into the emission characteristic of the display panel. When the luminance level is expressed by pulse width modulation, like this embodiment, the emission amount often exhibits a linear characteristic almost proportional to the size of luminance data. On the other hand, a video signal applies to a TV receiver using a CRT, and undergoes γ processing in order to correct the nonlinear emission characteristic of the CRT. For this reason, in displaying a TV image on a panel having a linear emission characteristic, like this embodiment, the effects of γ processing must be canceled by a tone level characteristic conversion means such as P7.

The emission characteristic can be properly changed by switching table data by an output from an I/O control unit; P13 serving as one of control inputs/outputs of the system control unit mainly made up of the MPU; P11.

Reference symbols P8 denote image memories which are arranged for respective R, G, and B processing circuits and have addresses for the total number of display pixels of the panel (in this case, 240 horizontal* 240 vertical lines* 3). Each memory stores luminance data each panel pixel should emit. Luminance data are dot-sequentially read out to display an image stored in the memory on the panel.

Luminance data is output from P8 under address control of the RAM controller; P12.

Data is written in P8 under the control of the system control unit mainly made up of the MPU; P11. For a simple test pattern, the MPU; P11 calculates, generates, and writes luminance data to be stored at each address in P8. For a natural still image pattern, an image file stored in, e.g., an external computer is read via a serial communication I/F; P16 serving as one of inputs/outputs of the system control unit mainly made up of the MPU; P11, and the read file is written in the image memory; P8.

Reference symbols P9 denote data selectors which determine whether image data to be output is data from the image memory; P8 or data from the A/D unit; P6 (input video signal system), on the basis of an output from the I/O control unit; P13 serving as one of control inputs/outputs of the system control unit mainly made up of the MPU; P11.

In addition to the two input selection systems, a mode of generating a fixed value from P9 is prepared. This mode can be selected by P13 to output the fixed value. In this mode, e.g., an adjustment signal such as a whole white pattern can be displayed at a high speed without any external input.

Reference symbols P10 denote horizontal 1-line memory means arranged for respective primary color signals. The horizontal 1-line memory means; P10 rearrange luminance data input parallel to the three, R, G, and B systems into an order corresponding to the color layout of the panel, convert the luminance data into a serial signal of one system, and output the converted signal to an X driver via a latch means; P22 in accordance with a control signal from a line memory control unit; P21.

The system control unit is mainly comprised of the MPU; P11, the serial communication I/F; P16, the I/O control unit; P13, the D/A unit; P14, the A/D unit; P15, a data memory; P17, and a user SW means; P18.

The system control unit receives a user request from the user SW means; P18 or serial communication I/F; P16, and outputs a corresponding control signal from the I/O control unit; P13 or D/A unit; P14 to meet the request.

In addition, the system control unit performs optimal automatic control by receiving a system monitoring signal from the A/D unit; P15 and outputting a corresponding control signal from the I/O control unit; P13 or D/A unit; P14.

This embodiment can realize generation of a test pattern, change of the tone level, and display control such as brightness or color control in accordance with a user request. By monitoring the average video level from the video detection unit; P4 by the A/D unit; P15, automatic control such as ABL can be achieved.

Since the data memory; P17 is adopted, it can store the user adjustment amount.

As shown in FIG. 3, the driver circuit comprises a Y-driver control timing generation unit P19 and an X-driver control timing generation unit P20. Both the Y-driver control generation unit P19 and X-driver control timing generation unit P20 receive signals CLK1, CLK2, and SYNC2 to generate Y-driver control and X-driver control signals. Reference symbol P21 denotes a control unit for performing timing control of the line memory; P10. P21 receives the signals CLK1, CLK2, and SYNC2, and generates R, G, and B_WRT control signals for writing luminance data in the line memory, and R, G, and B_RD control signals for reading out luminance data from the line memory in an order corresponding to the color layout of the panel.

Figure 5:
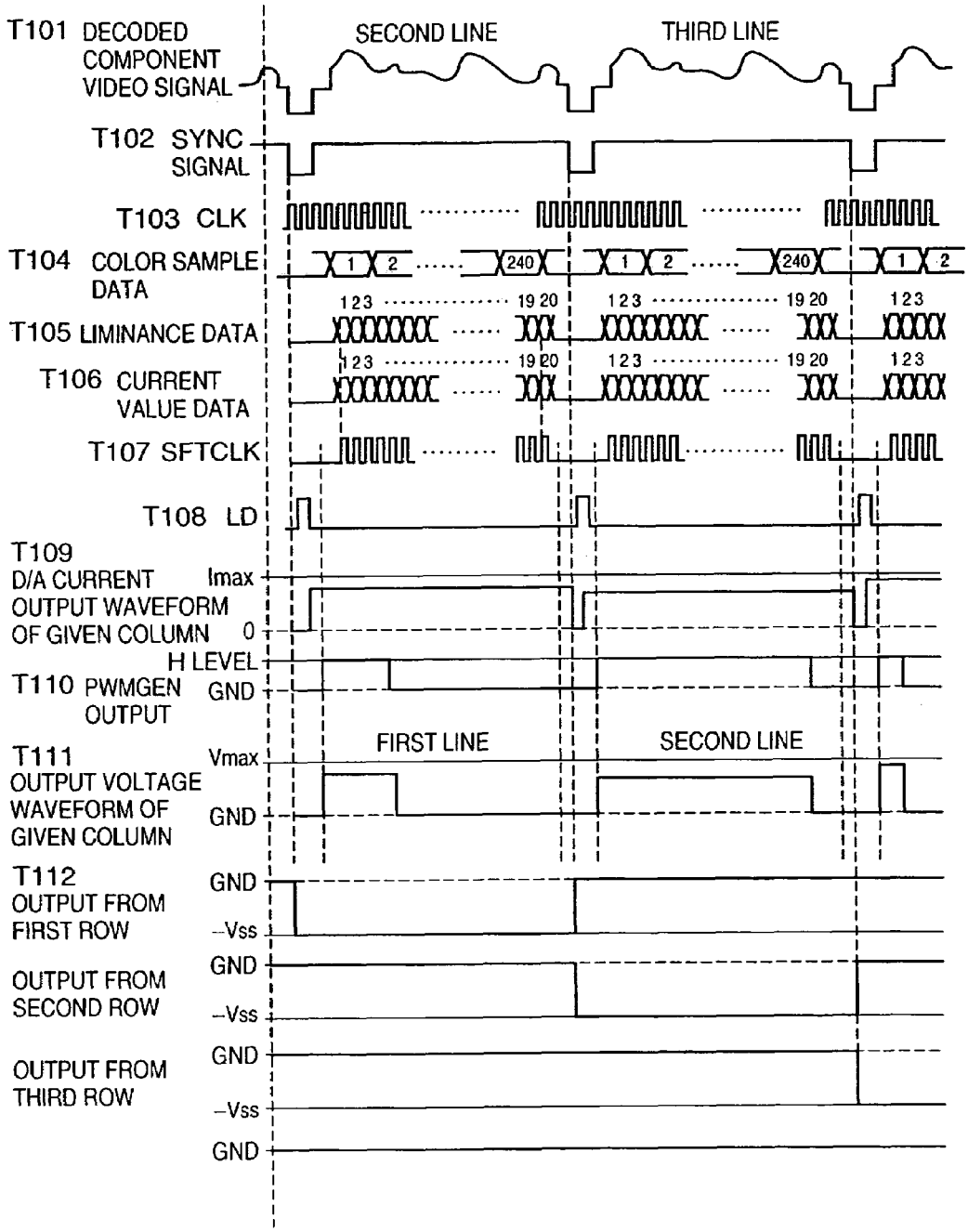
FIG. 5 is a timing chart for explaining the operation of a display panel driving circuit.

FIG. 5 is a timing chart showing the operation of the display panel driving apparatus described above. A signal T104 represents a color sample data string waveform obtained by displaying one of R, G, and B colors. The signal T104 is made up of 240 data strings per horizontal period. These data strings are written in the line memory; P10 in one horizontal period in accordance with a control signal. In the next horizontal period, data strings are read out from the line memory; P10 of each color at a frequency three times higher than the write frequency, thereby obtaining 720 luminance data strings per horizontal period, like T105.

An X & Y-driver timing generation unit P1001 receives a driver output control signal from the MPU; P11 and control signals from the Y-driver control timing generation unit P19 and X-driver control timing generation unit, and outputs signals necessary for the control of the X driver. The necessary signals are a shift clock serving as a PWM data shift control signal for reading luminance data from P22 into a shift register; P1101, a shift clock serving as a correction data shift control signal for reading correction data from P1201 into a shift register; P1107, and ~LD/ST pulses functioning as a horizontal period trigger and PWM start trigger as a PWM control signal and D/A control signal to PWM generation units; P1102 and D/A units; P1103 for fetching data read in the shift registers P1101 and P1107 in the internal memory means (not shown) of the PWM generation units; P1102 and D/A units; P1103.

The X & Y-driver timing generation unit P1001 outputs a PWM control signal for controlling the gate of the D/A output of each PWM generator P1102, and a D/A control signal for controlling the gate of the D/A output of each D/A P1103. As far as the PWM control signal and D/A control signal is disabled, the PWM generator P1102 and D/A P1103 do not output any signals.

The X & Y-driver timing generation unit P1001 outputs correction table ROM control signal.

The X & Y-driver timing generation unit P1001 outputs a Yout control signal for controlling the gate of a portion of a pre-driver unit that outputs a signal to an FET means in selecting a row wiring line. When the Yout control signal is disabled, all the row wiring lines keep receiving a non-selection potential.

The shift register; P1101 reads the luminance data strings of 720 column wiring lines from the latch means; P22 every horizontal period in accordance with a shift clock which synchronizes with luminance data such as T107 in FIG. 5 from the X & Y-driver timing generation unit P1001. Then, the shift register P1101 transfers 720 data of one horizontal line to the PWM generator units; P1102 at once in accordance with an "L"-level~LD/ST pulse such as T108.

The shift register; P1107 reads the column wiring driving current data strings of 720 column wiring lines from the data selector means; P1201 every horizontal period in accordance with a shift clock, similar to luminance data. Then, the shift register P1107 transfers 720 data of one horizontal line to the D/A units; P1103 at once in synchronism with an "L"-level~LD/ST pulse such as T108.

When the X & Y-driver timing generation unit P1001 does not enable any PWM control signal to the PWM GEN P1102, the PWM generator P1102 does not output any signal. If the PWM control signal is enabled, the PWM generator P1102 outputs a PWM output to a switching means; P1104. When the X & Y-driver timing generation unit P1001 does not enable any D/A control signal to the D/A P1103, the D/A unit P1103 does not output any current. If the D/A control signal is enabled, the D/A P1103 outputs a current output to the switching means; P1104.

A correction table ROM; P1202 is a memory means for storing, for R, G, and B, data of a current amplitude value to be flowed through 720*240 surface-conduction type devices of the display panel; P2000. The correction table ROM P1202 undergoes read address control in accordance with an correction table ROM control signal from the X & Y-driver timing generation unit P1001, and outputs data of 720 current amplitude values for one row to be scanned, such as T105 shown in FIG. 5, every horizontal period.

A current value for driving the column wiring line (i.e., surface-conduction type devices) is optimized using the correction table ROM; P1202 for each device, thereby making the luminance uniform.

The data selector means; P1201 is adopted for a case in which the correction table ROM; P1202 is not used in order to reduce the cost or the like. The data selector means; P1201 outputs, to the shift register; P1107 in accordance with a switching signal from the I/O control unit; P13, correction setting data output from the I/O control unit; P13 serving as one of control inputs/outputs of the system control unit mainly made up of the MPU; P11.

This circuit controls correction data with a current amplitude, but may control it with a voltage amplitude.

The PWM generator unit; P1102 arranged on each column wiring line receives luminance data from the shift register; P1101 when the ~LD/ST pulse T108 in FIG. 5 is at "L" level. After the ~LD/ST pulse rises, the PWM generator unit P1102 generates a pulse signal having a pulse width proportional to the data size every horizontal period, such as a waveform T110 in FIG. 5.

The D/A unit; P1103 arranged on each column wiring line is a digital-to-analog converter for a current output. This D/A unit P1103 receives data of a current amplitude value from the shift register; P1107, and generates a driving current having a current amplitude proportional to the data size every horizontal period, such as a waveform T111 in FIG. 5.

Reference symbols P1104 denote the switching means each formed from a transistor and the like. Each P1104 applies a current output from the D/A unit; P1103 to a column wiring line while an output from the PWM generation unit; P1102 is valid, and grounds the column wiring line while an output from the PWM generation unit; P1102 is invalid. A column wiring driving waveform is represented by T111 of FIG. 5.

Diode means; P1105 arranged on respective column wiring lines are connected on the common side to a Vmax regulator; P1106. The Vmax regulator; P1106 is a constant-voltage source capable of sucking a current, and forms together with the diode means; P1105 a protection circuit for preventing an excessive voltage from being applied to 720*240 surface-conduction type devices of the display panel; P2000.

The protection voltage (potential defined by Vmax and −Vss applied in scanning and selection of a row wiring line) is applied by the D/A unit; P14 serving as one of control inputs/outputs of the system control unit mainly made up of the MPU; P11.

Hence, the Vmax regulator P1106 can change the potential Vmax (or potential −Vss) in order to control the luminance in addition to avoid an excessive voltage to the device.

A Y shift register receives from the X & Y-driver timing generation unit P1001 a shift clock of a horizontal period and a trigger signal of a vertical period for supplying a row scanning start trigger, and sequentially outputs selection signals for scanning row wiring lines to pre-driver units arranged on respective row wiring lines.

When the X & Y-driver timing generation unit P1001 inputs an OFF signal to each pre-driver unit, the gate of a portion which outputs a signal to the FET means is turned off, and all the devices keep receiving a non-selection potential. When the X & Y-driver timing generation unit P1001 inputs an ON signal to the pre-driver unit, the gate of the portion which outputs a signal to the FET means is turned on, and row selection starts.

The output unit for driving each row wiring line is made up of, e.g., a transistor means, FET means, and diode means. The pre-driver drives this output terminal at a high response speed, and functions as a circuit for controlling application of a scanning signal. The pre-driver unit comprises a gate circuit for controlling an output to the FET means. In selecting a row, the FET means applies the potential −Vss from a constant-voltage regulator unit to the row wiring line via a switching means which is turned on in selection. In non-selection, the transistor means applies a potential Vuso from the constant-voltage regulator unit to the row wiring line via the switching means which is turned on when no row is selected. T112 shown in FIG. 5 is an example of a row wiring driving waveform.

Figure 6:
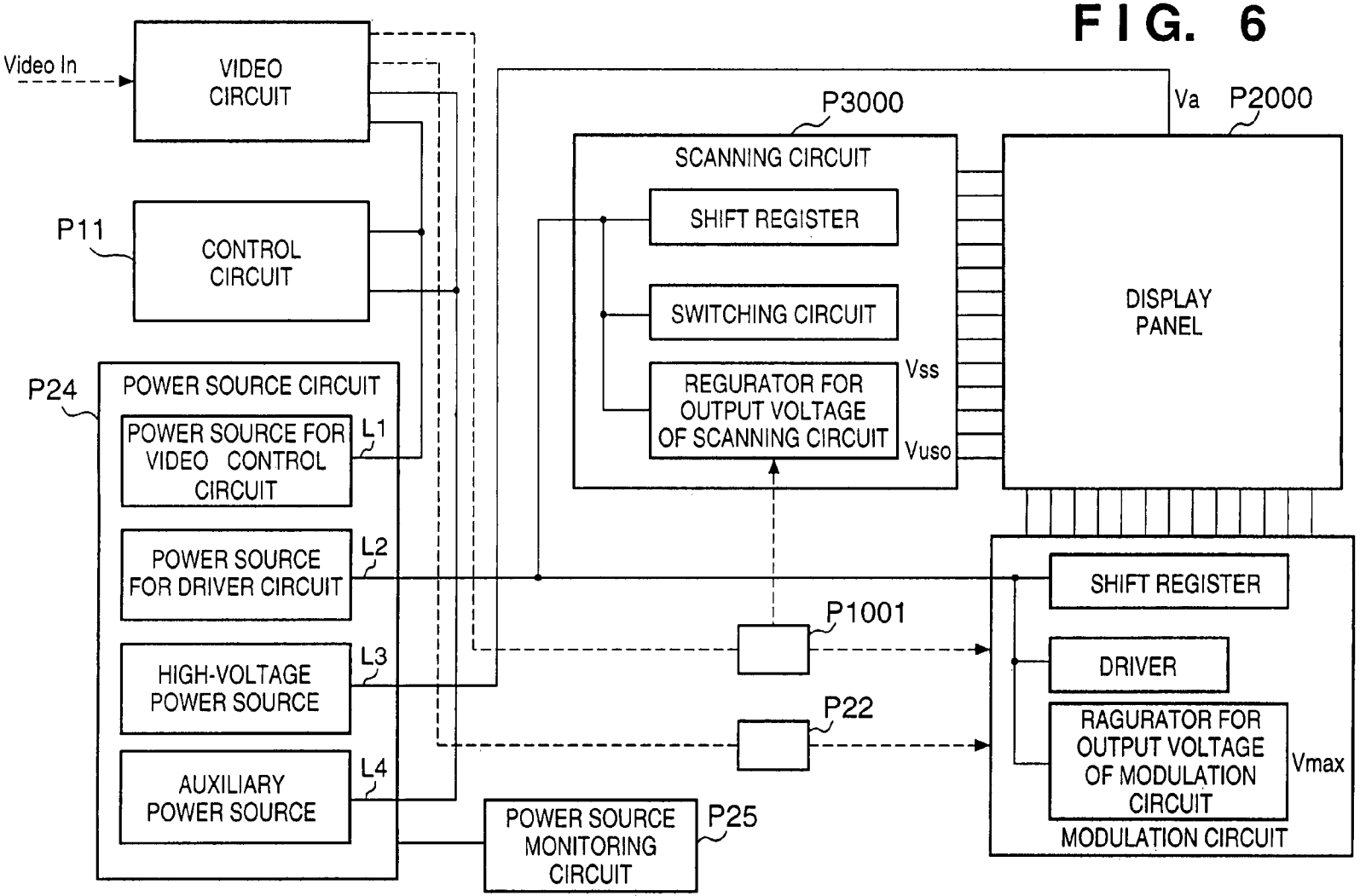
FIG. 6 is a block diagram showing a power source line layout.

FIG. 6 is a block diagram showing the power source line layout of the above-described image display apparatus. As shown in FIG. 6, a power source for the video/control circuit supplies power to the control circuit P11 and video circuit via a line L1. As described above, the video circuit sends a control signal to the X & Y-driver timing generation circuit P1001, and sends image data to the latch means P22 on the basis of an image signal input (Video In). A power source for the driver circuit supplies power to the modulation circuit via a line L2. As described above, the modulation circuit receives an output from the X & Y-driver timing generation circuit P1001, an output from the latch means P22, and an output from the data selector P1201, and parallel-outputs data in the column direction of the display panel P2000. A high-voltage power source supplies a high voltage Va to the display panel P2000 via a line L3. An auxiliary power source such as a capacitor or battery supplies power to the control circuit P11 and video circuit via a line L4. A power source circuit P24 is connected to a power source monitoring circuit P25.

Figure 7:
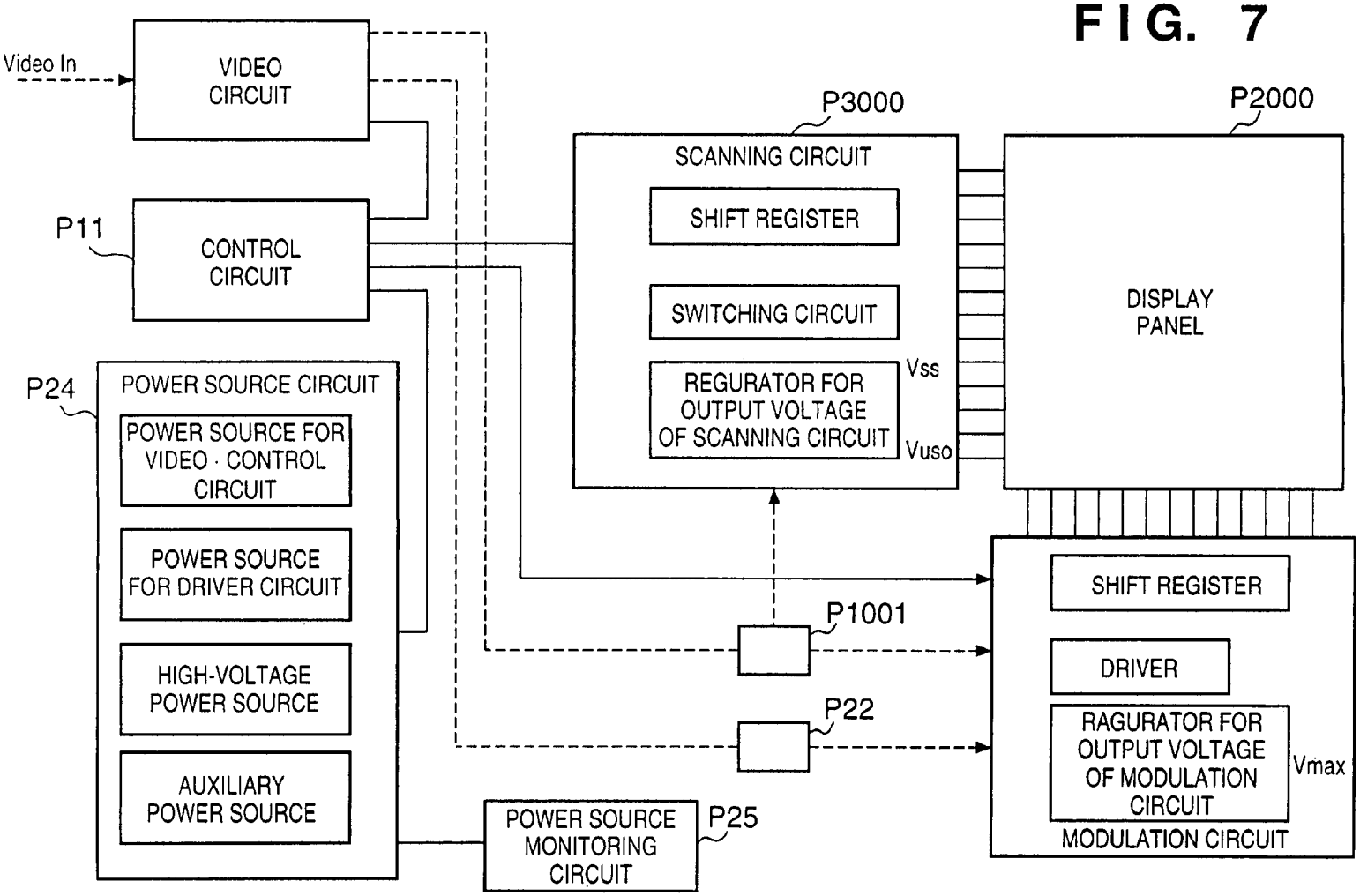
FIG. 7 is a block diagram showing the flow of a control signal for controlling supply of power.

FIG. 7 is a block diagram showing the flow of a control signal for controlling supply of power to the above-described image display apparatus. As shown in FIG. 7, the control circuit P11 controls the video circuit, power source circuit, scanning circuit, and modulation circuit.

Figure 8:
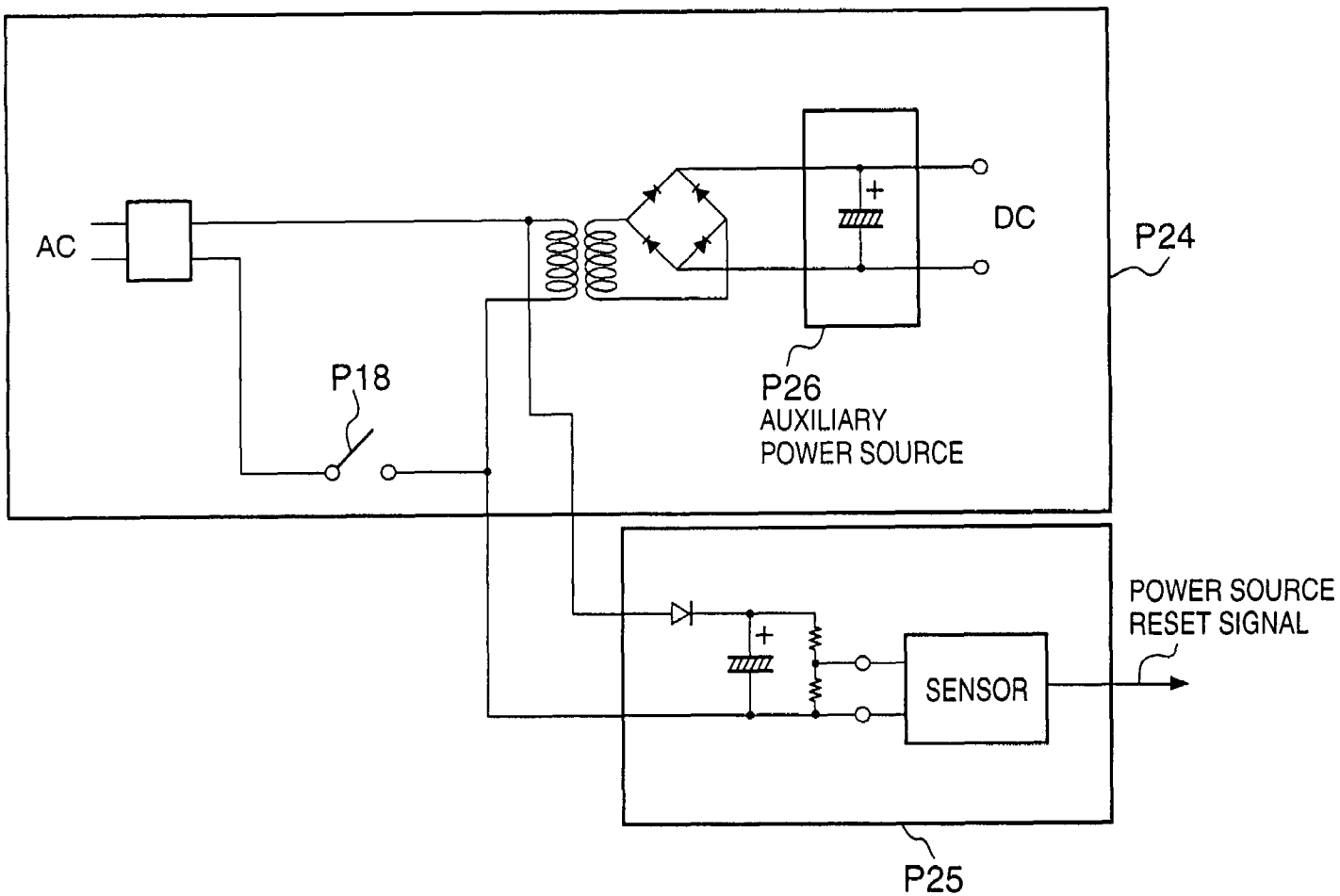
FIG. 8 is a circuit diagram showing a power source circuit and power source monitoring circuit.

FIG. 8 is a circuit diagram showing the power source circuit P24 and power source monitoring circuit P25.

The circuit shown in FIG. 8 gives the power source circuit P24 an emergency shutdown function, and includes the power source P24 for converting external AC power to DC power necessary for each circuit, the power monitoring circuit P25 for measuring the voltage of the power source P24 and when the voltage exceeds a specified potential, outputting a power source reset signal to the MPU; P11, and an auxiliary power source P26 for supplying power to each circuit while the following emergency shutdown sequence is completed when the power source is turned off.

The auxiliary power source P26 may be formed from a capacitor or battery. The power source monitoring circuit P25 is a resistor which is designed to divide a voltage into 5 V as a typical value. The power source monitoring circuit P25 is set to output a power reset signal to the MPU; P11 when the voltage becomes 35 V or less or 6 V or more.

The constant-voltage regulator unit (not shown) for generating the potentials −Vss and Vuso is controlled by the D/A unit; P14 serving as one of control inputs/outputs of the system control unit mainly made up of the MPU; P11.

The high-voltage power source unit (not shown) is also controlled by the D/A unit; P14 as one of control inputs/outputs of the system control unit mainly made up of the MPU; P11.

The potential Vuso may be 0 V. In this case, the constant-voltage regulator unit for generating the potential Vuso can be replaced with a GND circuit.

Figure 9:
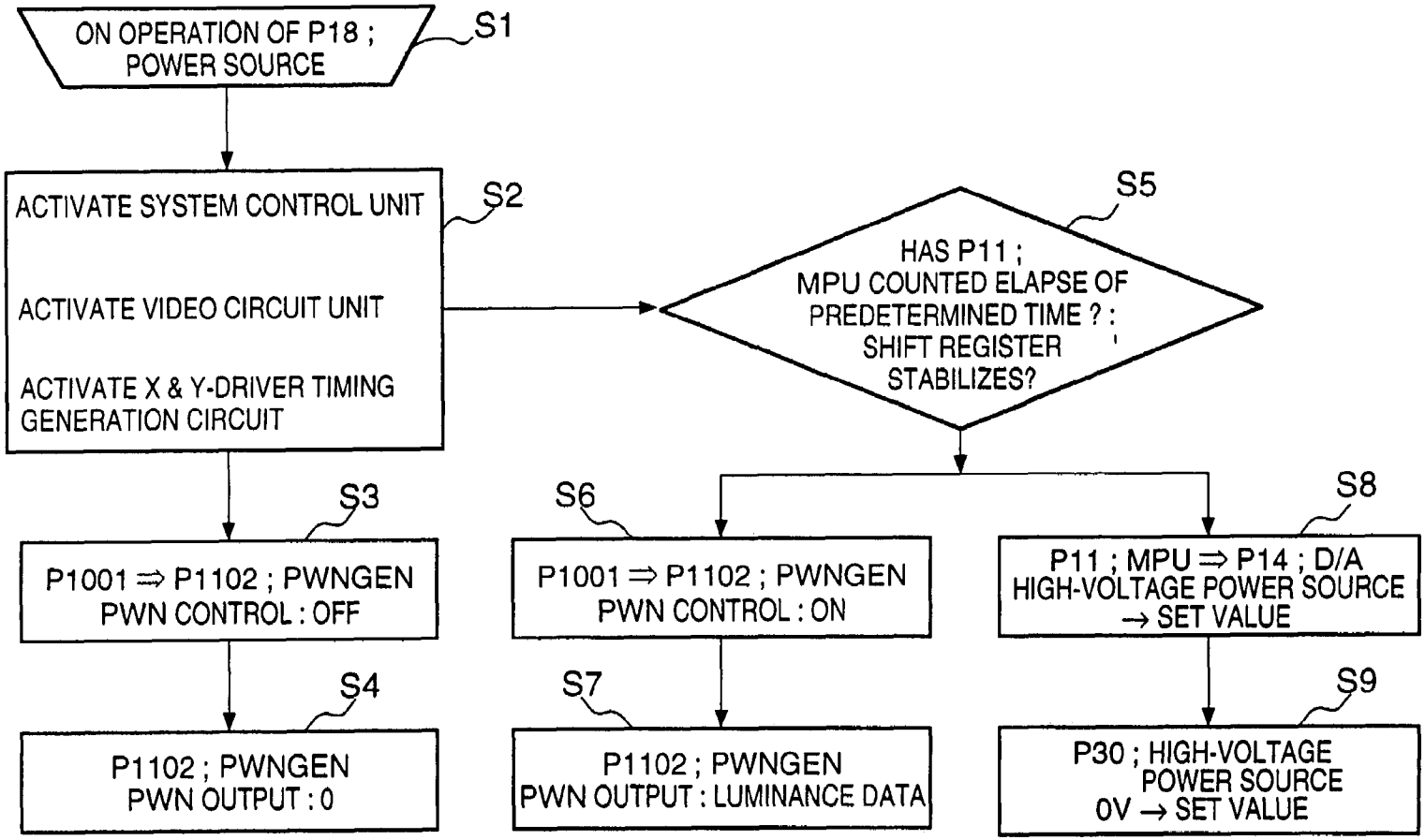
FIG. 9 is a flowchart according to the first embodiment.

The power-on sequence of this embodiment will be explained with reference to the flow chart of FIG. 9.

In step S1, if a power switch as one of the user SW means; P18 is turned on, the power sources of respective circuits are turned on to activate these circuits in step S2.

In step S3, immediately after the power source is turned on, a PWM control signal output from the X & Y-driver timing generation unit P1001 to the PWM generator is kept disabled. The gate is kept off for an output from the PWM generator P1102, and no PWM signal is applied to the panel. Upon power-on operation, data in the shift register is not determined, but no driving signal is applied to the surface-conduction type device; P2001 of the display panel P2000, thereby preventing degradation and destruction of the device caused by an indeterminate signal upon power-on operation.

If the system control unit is activated in step S2, the MPU; P11 of the system control unit starts counting vertical sync signals of an image in step S5. Data in the shift register is not determined immediately upon power-on operation, and the MPU; P11 counts vertical sync signals until data in the shift register stabilizes. In this case, the shift register satisfactorily stabilizes when the count value reaches three. That is, when the count value reaches three, and the shift register stabilizes, control of the PWM generator P1102 starts in step S6. In step S7, the X & Y-driver timing generation unit P1001 outputs an ON signal as a PWM control signal to the PWM generator P1102 to turn on the gate of the PWM generator. Then, a PWM output is applied to the surface-conduction type device; P2001 of the display panel P2000 via the switching means; P1104.

If the count value reaches three, and the shift register stabilizes in step S5, the MPU; P11 inputs to the high-voltage power source unit; P30 via the D/A unit; P14 a signal for controlling a high-voltage potential from 0 V to a set value (in this case, 5 to 10 kV) in step S8. In step S9, an output from the high-voltage power source unit; P30 changes to the set value (in this case, 5 to 10 kV).

When the power switch is turned on, each signal is applied by this sequence without degrading or damaging the device by an indeterminate signal to the surface-conduction type device; P2001 of the display panel; P2000.

In this embodiment, a time within which data in the shift register stabilizes is measured in advance, vertical sync signals are counted, and when the count value reaches three, the next sequence is executed. The delay time depends on the time within which data in the shift register stabilizes, and is not necessarily limited by this time. Although the delay time is calculated based on vertical sync signals in this embodiment, the delay time may be calculated based on horizontal sync signals or a delay timer may be attached. The delay method is not limited. Further, in this embodiment, an output from the driving circuit unit is controlled by outputting a gate signal from the X & Y-driver timing generation unit P1001. However, the output control is not limited to this, and the MPU; P11 of the system control unit or another control system may be used.

Moreover, the power source can be turned on by the same sequence even in a circuit arrangement in which the amplitude of luminance data is modulated to PWM-output correction data, instead of PWM-outputting luminance data in step S7.

Second Embodiment

Figure 10:
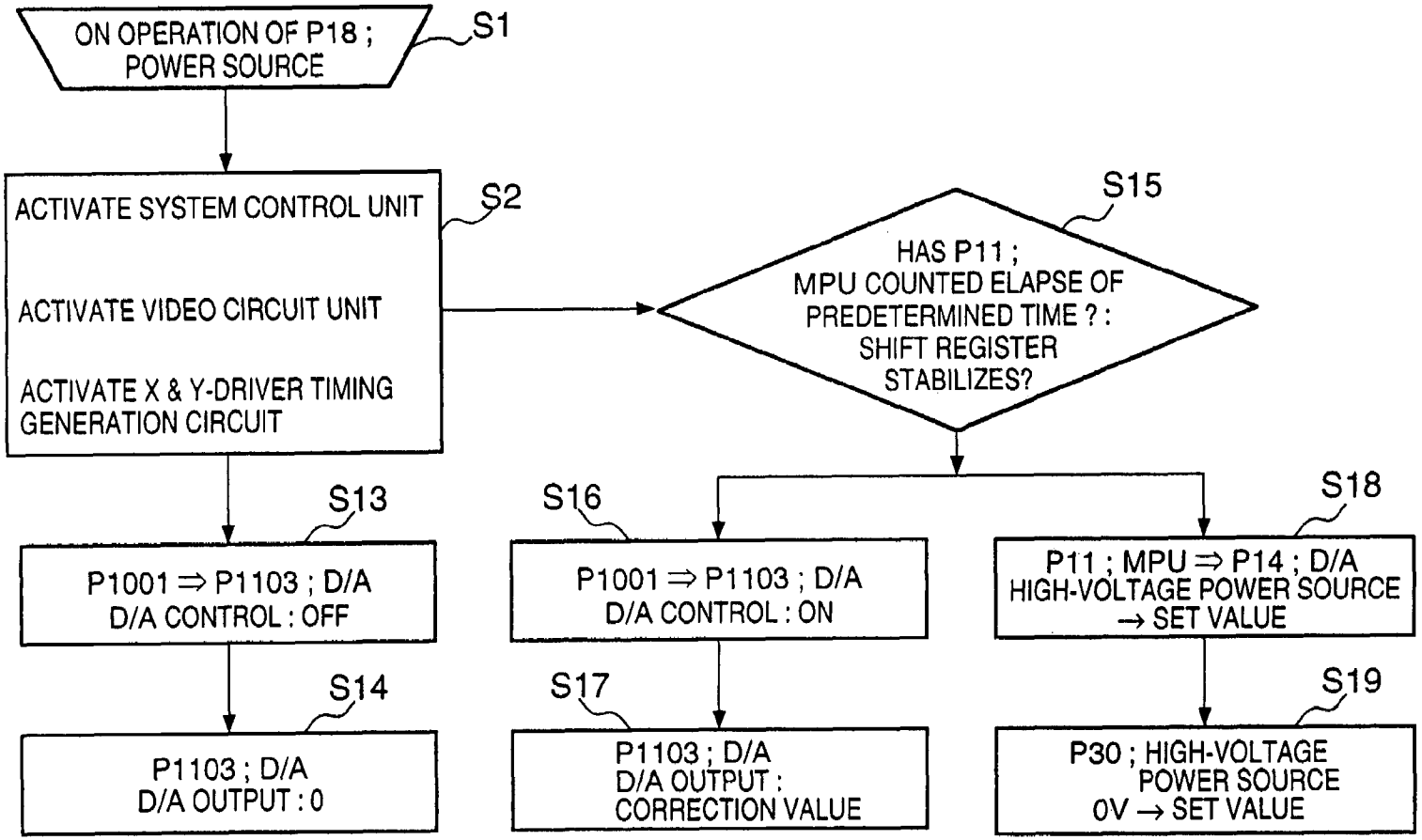
FIG. 10 is a flow chart according to the second embodiment.

This embodiment adopts a different power-on sequence with the same arrangement as in the first embodiment. The power-on sequence in the second embodiment will be explained with reference to the flow chart of FIG. 10.

If a power switch as one of user SW means; P18 is turned on (step S11), the power sources of respective circuits are turned on to activate these circuits (step S12).

Immediately after the power source is turned on, a D/A control signal output from an X & Y-driver timing generation unit P1001 to a D/A unit P1003 is kept disabled (step S3). The gate is kept off for an output from the D/A unit P1103, and no set current value corresponding to correction data is applied to the panel. Upon power-on operation, data in a shift register is not determined, but no driving signal is applied to a surface-conduction type device; P2001 of a display panel; P2000, thereby preventing degradation and destruction of the device caused by an indeterminate signal upon power-on operation.

If a system control unit is activated (step S12), an MPU; P11 of the system control unit starts counting vertical sync signals of an image. Data in the shift register is not determined immediately upon power-on operation, and the MPU; P11 counts vertical sync signals until data in the shift register stabilizes. In this case, the shift register satisfactorily stabilizes when the count value reaches three.

That is, when the count value reaches three, and the shift register stabilizes (step S15), the X & Y-driver timing generation unit P1001 outputs an ON signal as a D/A control signal to the D/A unit P1103 (step S16) to turn on the gate of the D/A unit; P1103. Then, a set current value is applied to the surface-conduction type device; P2001 of the display panel; P2000 via a switching means; P1104.

If the count value reaches three, and the shift register stabilizes (step S15), the MPU; P11 inputs to a high-voltage power source unit; P30 via a D/A unit P14 a signal for controlling a high-voltage potential from 0 V to a set value (in this case, 5 to 10 kV) (step S18). Then, an output from the high-voltage power source unit; P30 changes to the set value (in this case, 5 to 10 kV) (step S19).

When the power switch is turned on, each signal is applied by this sequence without degrading or damaging the device by an indeterminate signal to the surface-conduction type device; P2001 of the display panel P2000.

In this embodiment, a time within which data in the shift register stabilizes is measured in advance, vertical sync signals are counted, and when the count value reaches three, the next sequence is executed. The delay time depends on the time within which data in the shift register stabilizes, and is not necessarily limited by this time. Although the delay time is calculated based on vertical sync signals in this embodiment, the delay time may be calculated based on horizontal sync signals or a delay timer may be attached. The delay method is not limited. Further, in this embodiment, an output from the driving circuit unit is controlled by outputting a gate signal from the X & Y-driver timing generation unit P1001. However, the output control is not limited to this, and the MPU; P11 of the system control unit or another control system may be used.

Moreover, the power source can be turned on by the same sequence even in a circuit arrangement in which the amplitude of luminance data is modulated to PWM-output correction data, instead of D/A-outputting a correction value in step S17.

Third Embodiment

Figure 11:
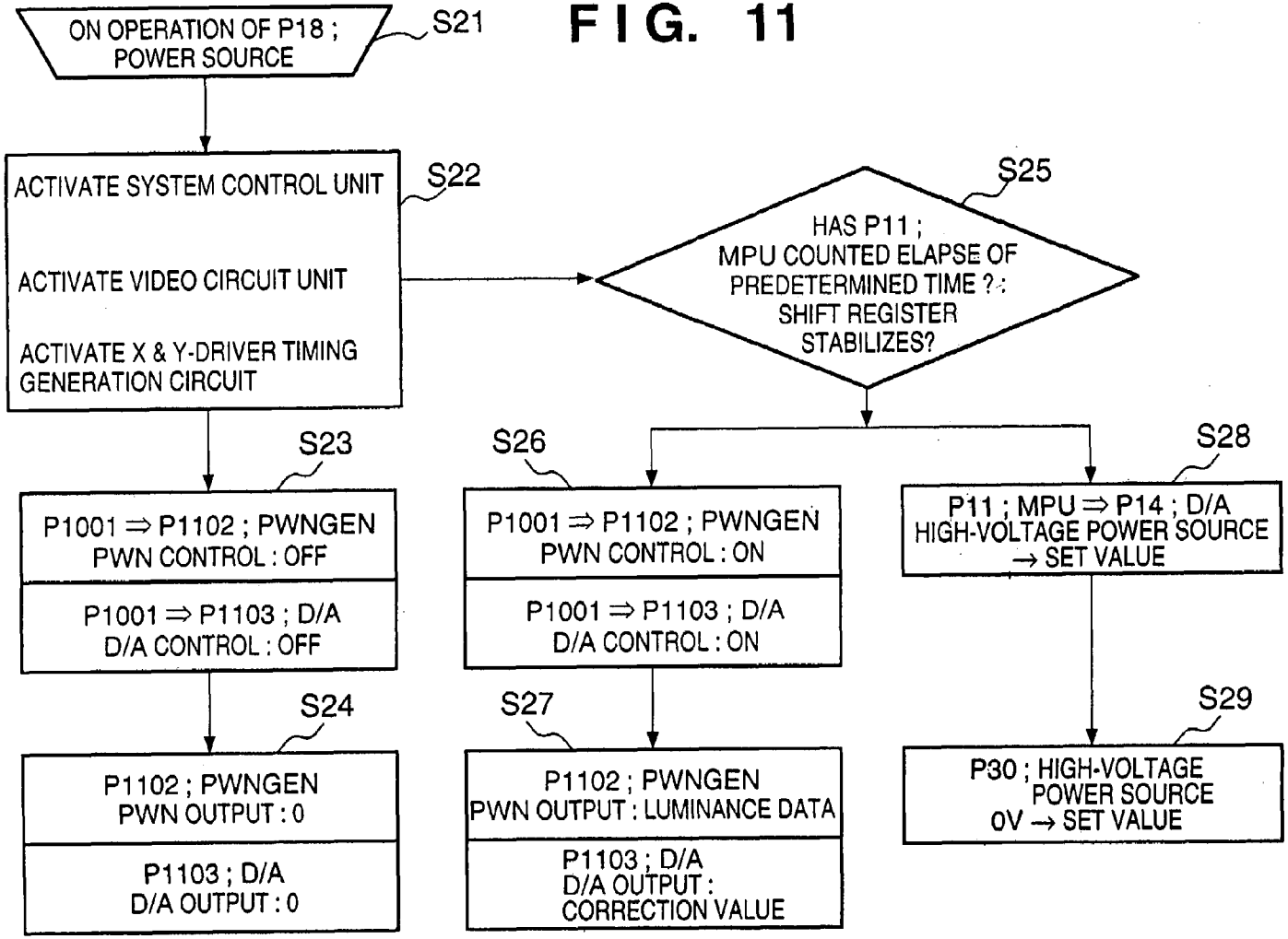
FIG. 11 is a flow chart according to the third embodiment.

This embodiment employs a different power-on sequence with the same arrangement as in the first embodiment. The power-on sequence in the third embodiment will be explained with reference to FIG. 11.

1)

If a power switch as one of user SW means; P18 is turned on (step S21), the power sources of respective circuits are turned on to activate these circuits (step S22). Immediately after the power source is turned on, a PWM control signal output from an X & Y-driver timing generation unit P1001 to a PWM generator P1102, and a D/A control signal output from the X & Y-driver timing generation unit P1001 to a D/A unit P1003 are kept disabled (step S23). The gate is kept off for an output from the PWM generator P1102, and no PWM signal is applied to a panel. The gate is kept off for an output from the D/A unit P1103, and no set current value corresponding to correction data is applied. Upon power-on operation, data in a shift register is not determined, but no driving signal is applied to a surface-conduction type device; P2001 of a display panel; P2000, thereby preventing degradation and destruction of the device caused by an indeterminate signal upon power-on operation.

If a system control unit is activated (step S22), an MPU; P11 of the system control unit starts counting vertical sync signals of an image. Data in the shift register is not determined immediately upon power-on operation, and the MPU; P11 counts vertical sync signals until data in the shift register stabilizes. In this case, the shift register satisfactorily stabilizes when the count value reaches three.

That is, when the count value reaches three, and the shift register stabilizes (step S25), the X & Y-driver timing generation unit P1001 outputs an ON signal as a PWM control signal to the PWM generator P1102. At the same time, the X & Y-driver timing generation unit P1001 outputs an ON signal as a D/A control signal to the D/A unit P1103 (step S26). Then, the gate of the PWM generator is turned on, and the gate of the D/A unit; P1103 is turned on. A PWM output and set current value are applied to the surface-conduction type device; P2001 of the display panel; P2000 via a switching means; P1104.

If the count value reaches three, and the shift register stabilizes (step S25), the MPU; P11 inputs to a high-voltage power source unit; P30 via a D/A unit P14 a signal for controlling a high-voltage potential from 0 V to a set value (in this case, 5 to 10 kV) (step S28). Then, an output from the high-voltage power source unit; P30 changes to the set value (in this case, 5 to 10 kV) (step S29).

When the power switch is turned on, each signal is applied by this sequence without degrading or damaging the device by an indeterminate signal to the surface-conduction type device; P2001 of the display panel; P2000.

In this embodiment, a time within which data in the shift register stabilizes is measured in advance, vertical sync signals are counted, and when the count value reaches three, the next sequence is executed. The delay time depends on the time within which data in the shift register stabilizes, and is not necessarily limited by this time. Although the delay time is calculated based on vertical sync signals in this embodiment, the delay time may be calculated based on horizontal sync signals or a delay timer may be attached. The delay method is not limited. Further, in this embodiment, an output from the driving circuit unit is controlled by outputting a gate signal from the X & Y-driver timing generation unit P1001. However, the output control is not limited to this, and the MPU; P11 of the system control unit or another control system may be used.

The power source can be turned on by the same sequence even in a circuit arrangement in which the amplitude of luminance data is modulated to PWM-output correction data, instead of D/A-outputting a correction value in step S27.

Fourth Embodiment

Figure 12:
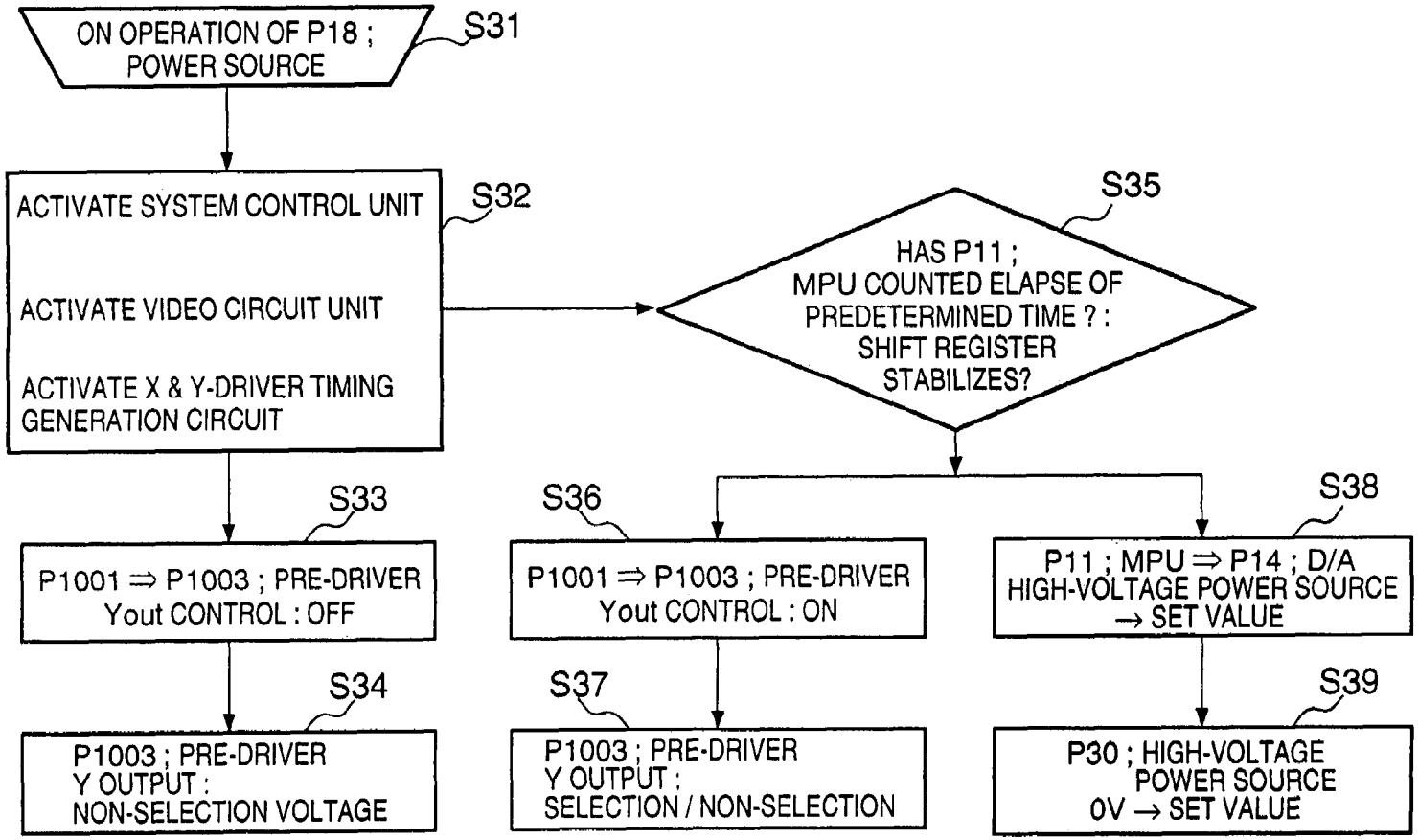
FIG. 12 is a flow chart according to the fourth embodiment.

This embodiment relates to a different power-on sequence with the same arrangement as in the first embodiment. The power-on sequence in the fourth embodiment will be explained with reference to FIG. 12.

1) If a power switch as one of user SW means; P18 is turned on (step S31), the power sources of respective circuits are turned on to activate these circuits (step S32). Immediately after the power source is turned on, a Yout control signal output from an X &Y-driver timing generation unit P1001 to a pre-driver is kept disabled (step S33). The gate is kept off for an output from the pre-driver to an FET means, the row wiring side is kept unselected, and no selection voltage is applied to a panel. Upon power-on operation, data in a shift register is not determined, but no selection potential in scanning is applied to a surface-conduction type device; P2001 of a display panel; P2000, thereby preventing degradation and destruction of the device caused by an indeterminate signal upon power-on operation.

If a system control unit is activated (step S32), an MPU; P11 of the system control unit starts counting vertical sync signals of an image. Data in the shift register is not determined immediately upon power-on operation, and the MPU; P11 counts vertical sync signals until data in the shift register stabilizes. In this case, the shift register satisfactorily stabilizes when the count value reaches three.

That is, when the count value reaches three, and the shift register stabilizes (step S35), the X & Y-driver timing generation unit P1001 outputs an ON signal as a Yout control signal to the pre-driver (step S36). Then, the gate of a portion which outputs a signal to the FET means is turned on to start row selection.

If the count value reaches three, and the shift register stabilizes (step S35), the MPU; P11 inputs to a high-voltage power source unit; P30 via a D/A unit P14 a signal for controlling a high-voltage potential from 0 V to a set value (in this case, 5 to 10 kV) (step S38). Then, an output from the high-voltage power source unit; P30 changes to the set value (in this case, 5 to 10 kV) (step S39).

When the power switch is turned on, each signal is applied by this sequence without degrading or damaging the device by an indeterminate signal to the surface-conduction type device; P2001 of the display panel; P2000.

In this embodiment, a time within which data in the shift register stabilizes is measured in advance, vertical sync signals are counted, and when the count value reaches three, the next sequence is executed. The delay time depends on the time within which data in the shift register stabilizes, and is not necessarily limited by this time. Although the delay time is calculated based on vertical sync signals in this embodiment, the delay time may be calculated based on horizontal sync signals or a delay timer may be attached. The delay method is not limited. Further, in this embodiment, an output from the driving circuit unit is controlled by outputting agate signal from the X & Y-driver timing generation unit P1001. However, the output control is not limited to this, and the MPU; P11 of the system control unit or another control system may be used.

The power source can be turned on by the same sequence even in a circuit arrangement in which the amplitude of luminance data is modulated to PWM-output correction data, instead of a Y output in step S37.

Upon power-on operation, the modulation signal side in the first to third embodiments, or the scanning signal side in the fourth embodiment stops an output for stabilizing data in the shift register. Alternatively, both the modulation signal side and scanning signal side may be stopped.

Fifth Embodiment

Figure 13:
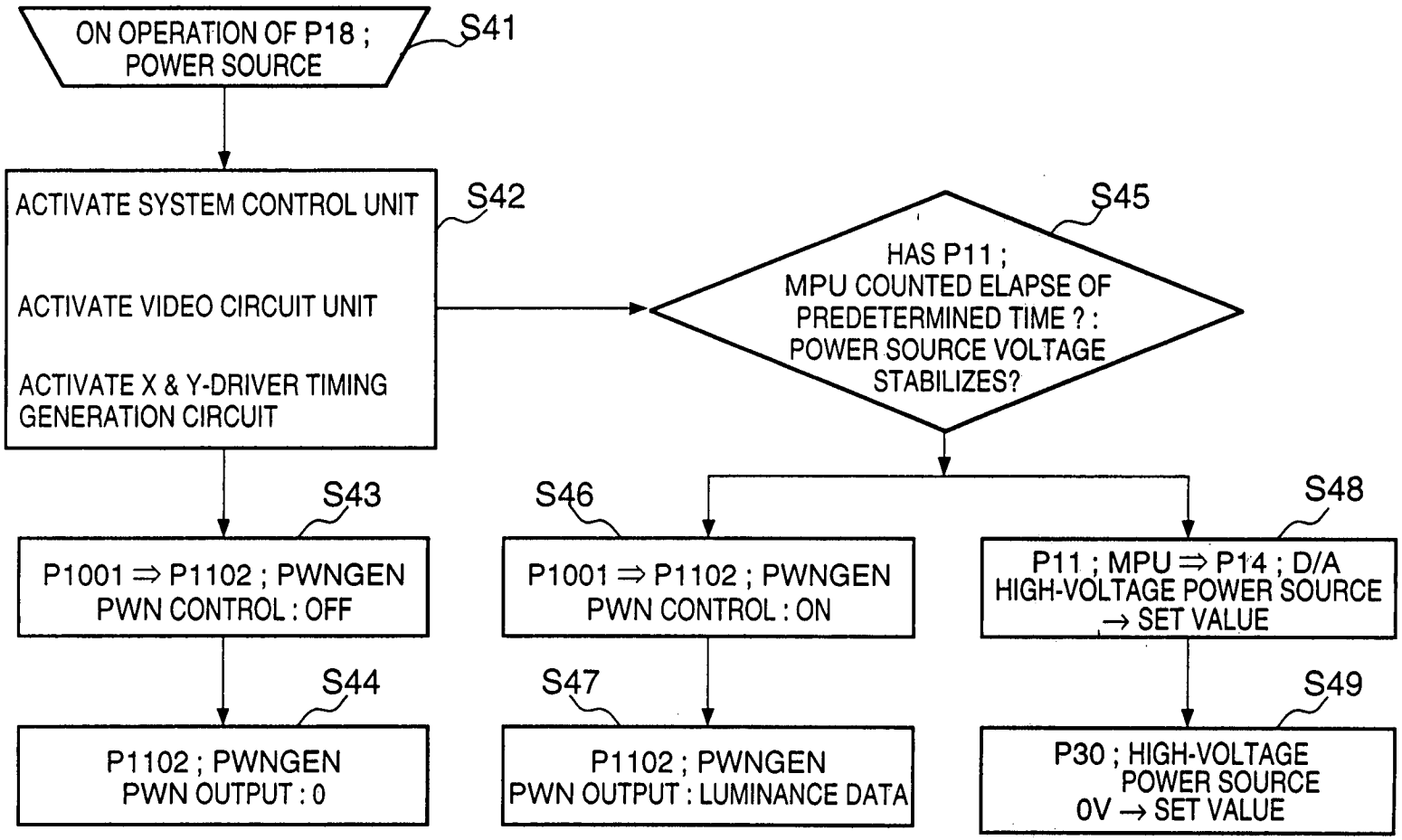
FIG. 13 is a flow chart according to the fifth embodiment.

This embodiment concerns a different power-on sequence with the same arrangement as in the first embodiment. This embodiment will describe a sequence of stopping either one of an output from a scanning circuit and an output from a modulation circuit until the power source voltages of the scanning circuit and modulation circuit reach desired values upon power-on operation. The power-on sequence in the fifth embodiment will be explained with reference to FIG. 13.

If a power switch as one of user SW means; P18 is turned on (step S41), the power sources of respective circuits are turned on to activate these circuits (step S42). Immediately after the power source is turned on, a PWM control signal output from an X & Y-driver timing generation unit P1001 to a PWM generator. P1102 is kept disabled (step S43). The gate is kept off for an output from the PWM generator P1102, and no PWM signal is applied to a panel.

Upon power-on operation, the power source voltage (output voltages from a Vuso regulator and −Vss regulator) of the scanning circuit on a row wiring line; P2002 side, and the power source voltage (output voltage from a Vmax regulator; P1106) of the modulation circuit on a column wiring line; P2003 side do not reach desired values. However, no driving signal is applied to a surface-conduction type device, P2001 of a display panel; P2000, thereby preventing degradation and destruction of the device caused by an indeterminate power source voltage upon power-on operation.

If a system control unit is activated (step S42), an MPU; P11 of the system control unit starts counting vertical sync signals of an image. The power source voltage (output voltages from the Vuso regulator and −Vss regulator) of the scanning circuit on the row wiring line; P2002 side, and the power source voltage (output voltage from the Vmax regulator; P1106) of the modulation circuit on the column wiring line; P2003 side do not reach desired values. The MPU; P11 counts vertical sync signals until the power source voltages of the scanning circuit and modulation circuit reach desired values. In this case, the power source voltages of the scanning circuit and modulation circuit reach desired values when the count value reaches three.

That is, when the count value reaches three, and the power source voltage (output voltages from the Vuso regulator and −Vss regulator) of the scanning circuit on the row wiring line; P2002 side and the power source voltage (output voltage from the Vmax regulator; P1106) of the modulation circuit on the column wiring line; P2003 side reach desired values (step S45), the X & Y-driver timing generation unit P1001 outputs an ON signal as a PWM control signal to the PWM generator P1102 (step S46). Then, the gate of the PWM generator is turned on to apply a PWM output to the surface-conduction type device; P2001 of the display panel P2000 via a switching means; 1104.

If the count value reaches three, and the power source voltage (output voltages from the Vuso regulator and −Vss regulator) of the scanning circuit on the row wiring line; P2002 side and the power source voltage (output voltage from the Vmax regulator; P1106) of the modulation circuit on the column wiring line; P2003 side reach desired values (step S45) the MPU; P11 inputs to a high-voltage power source unit; P30 via a D/A unit P14 a signal for controlling a high-voltage potential from 0 V to a set value (in this case, 5 to 10 kV) (step S48). Then, an output from the high-voltage power source unit; P30 changes to the set value (in this case, 5 to 10 kV) (step S49).

When the power switch is turned on, each signal is applied by this sequence without degrading or damaging the device by an indeterminate power source voltage to the surface-conduction type device; P2001 of the display panel P2000.

In this embodiment, the gate of the PWM output unit; P1102 is controlled to be kept off until the power source voltage (output voltages from the Vuso regulator and −Vss regulator) of the scanning circuit on the row wiring line; P2002 side and the power source voltage (output voltage from the Vmax regulator; P1106) of the modulation circuit on the column wiring line; P2003 side reach desired values. Alternatively, the gate of the PWM output unit; P1102 may be controlled by turning off the gate of a D/A unit; P1103 for controlling the current amplitude, or by turning off the gate of a pre-driver on the row wiring line; P2002 side.

In this embodiment, a time is measured in advance within which the power source voltage (output voltages from the Vuso regulator and −Vss regulator) of the scanning circuit on the row wiring line; P2002 side and the power source voltage (output voltage from the Vmax regulator; P1106) of the modulation circuit on the column wiring line; P2003 side reach desired values. Then, vertical sync signals are counted, and when the count value reaches three, the next sequence is executed. The delay time depends on the time within which the power source voltage (output voltages from the Vuso regulator and −Vss regulator) of the scanning circuit on the row wiring line; P2002 side and the power source voltage (output voltage from the Vmax regulator; P1106) of the modulation circuit on the column wiring line; P2003 side reach desired values. The delay time is not necessarily limited by this time. Although the delay time is calculated based on vertical sync signals in this embodiment, the delay time may be calculated based on horizontal sync signals or a delay timer may be attached. The delay method is not limited to a specific one. Further, in this embodiment, an output from the driving circuit unit is controlled by outputting a gate signal from the X & Y-driver timing generation unit P1001. However, the output control is not limited to this, and the MPU; P11 of the system control unit or another control system may be used.

The power source can be turned on by the same sequence even in a circuit arrangement in which the amplitude of luminance data is modulated to PWM-output correction data, instead of PWM-outputting luminance data in step s47.

Sixth Embodiment

Figure 14:
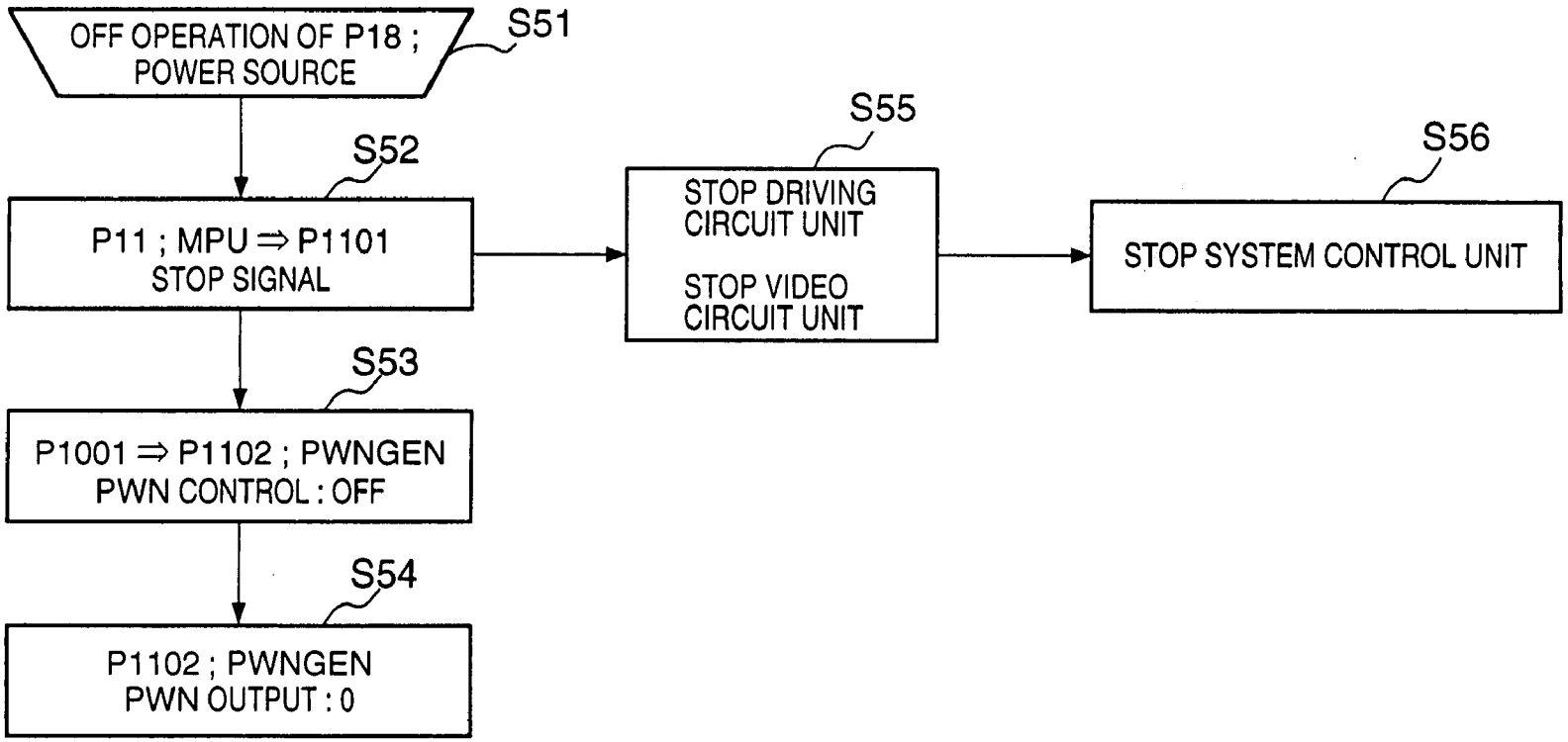
FIG. 14 is a flow chart according to the sixth embodiment.

This embodiment relates to a power-off sequence with the same arrangement as in the first embodiment. The power-off sequence in the sixth embodiment will be explained with reference to FIG. 14.

If a power switch as one of user SW means; P18 is turned off (step S51), a power stop signal is input to an MPU; P11 via an I/O control unit; P13 (step S52).

If the power source stop signal is input to the MPU; P11, the MPU; P11 outputs a stop signal for a driver output control signal to an X & Y-driver timing generation unit P1001. The X & Y-driver timing generation unit P1001 immediately outputs a signal for turning off the gate of a PWM generator; P1102 (step S53).

This gate-off signal immediately stops a PWM output (step S54). In this state, no driving signal is applied to a surface-conduction type device; P2001 of a display panel; P2000. The surface-conduction type device; P2001 of the display panel; P2000 is not deteriorated or destructed regardless of unstable voltages output upon power-off operation from the power source voltage (output voltages from a Vuso regulator and −Vss regulator) of a scanning circuit on a row wiring line; P2002 side and the power source voltage (output voltage from a Vmax regulator; P1106) of a modulation circuit on a column wiring line; P2003.

After the X & Y-driver timing generation unit P1001 outputs the signal for turning off the gate of the PWM generator; P1102 (step S53), supply of power to a driving circuit unit and video circuit unit is stopped (step S55), and supply of power to a system control unit is stopped (step S56).

When the power switch is turned off, supply of power is stopped by this sequence without degrading or damaging the device by an indeterminate power source voltage to the surface-conduction type device; P2001 of the display panel P2000.

In this embodiment, when the power source is turned off, the gate of the PWM output unit; P1102 is controlled to be immediately turned off. Alternatively, the gate of the PWM output unit P1102 may be controlled by turning off the gate of a D/A unit; P1103 for controlling the current amplitude, or by turning off the gate of a pre-driver on the row wiring line; P2002 side.

In this embodiment, an output from the driving circuit unit is controlled by outputting a gate signal from the X & Y-driver timing generation unit P1001. However, the output control is not limited to this, and the MPU; P11 of the system control unit or another control system may be used.

The power source can be turned off by the same sequence even in a circuit arrangement in which the amplitude of luminance data is modulated to PWM-output correction data.

Seventh Embodiment

Figure 15:
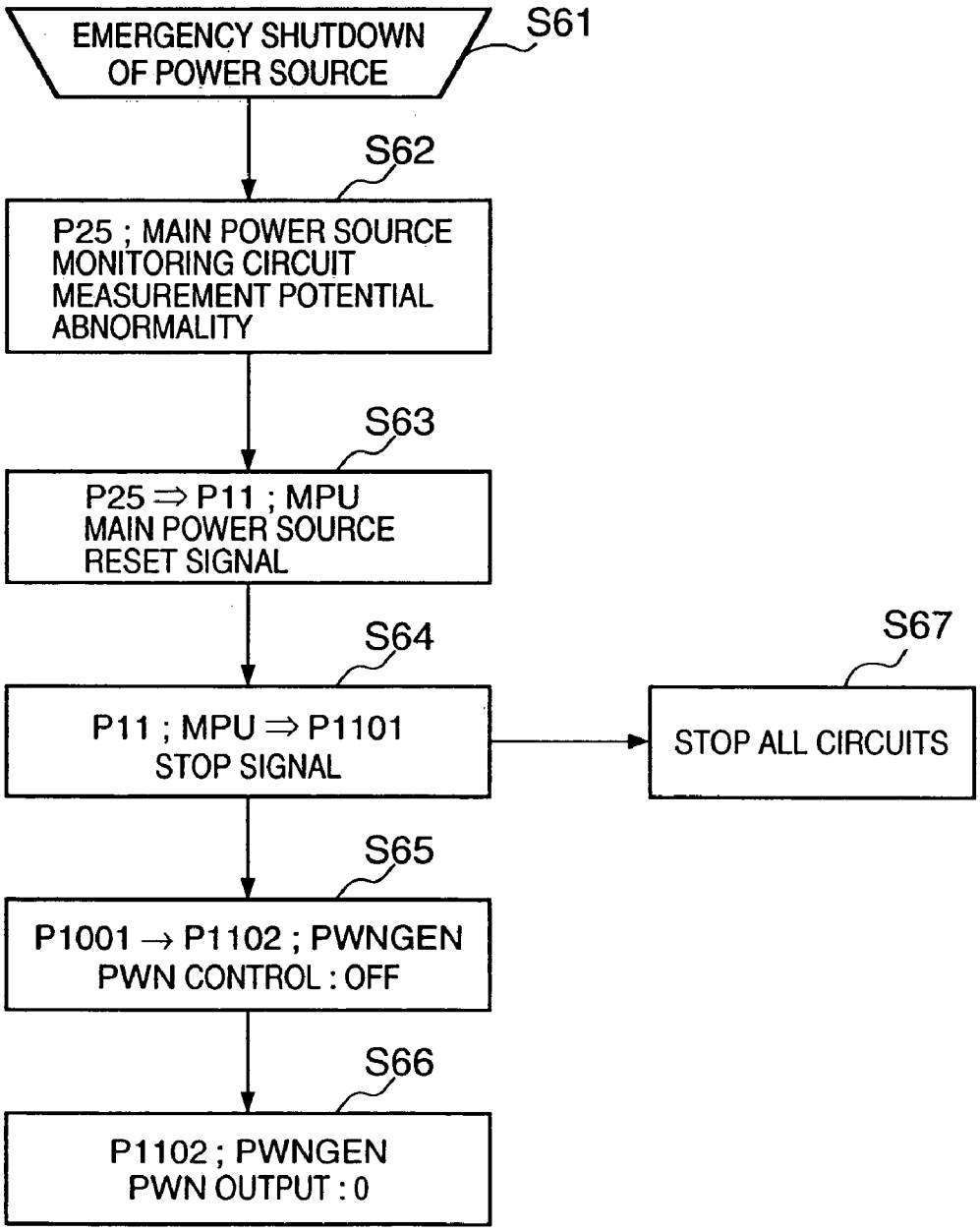
FIG. 15 is a flow chart according to the seventh embodiment.

This embodiment concerns a sequence in emergency shutdown of the power source when an outlet is removed or power fails, with the same arrangement as in the first embodiment. To emergently shutting down a power source when an outlet is removed or power fails, an emergency shutdown circuit as shown in FIG. 8 is required. The power shutdown sequence in the seventh embodiment will be explained with reference to FIG. 15.

If an outlet is removed or power fails (step S61), a power source monitoring circuit; P25 observes a voltage abnormality (step S62). The power source monitoring circuit; P25 outputs a power source reset signal to an MPU; P11 (step S63).

If the power source monitoring circuit; P25 inputs the power source reset signal to the MPU; P11, the MPU; P11 outputs a stop signal for a driver output control signal to an X & Y-driver timing generation unit P1001. The X & Y-driver timing generation unit P1001 immediately outputs a signal for turning off the gate of a PWM generator; P1102 (step S64).

This gate-off signal immediately stops a PWM output (step S65). In this state, no driving signal is applied to a surface-conduction type device; P2001 of a display panel; P2000. The surface-conduction type device; P2001 of the display panel; P2000 is not deteriorated or destructed regardless of unstable voltages output upon power-off operation from the power source voltage (output voltages from a Vuso regulator and −Vss regulator) of a scanning circuit on a row wiring line; P2002 side and the power source voltage (output voltage from a Vmax regulator; P1106) of a modulation circuit on a column wiring line; P2003.

After the X & Y-driver timing generation unit P1001 outputs the signal for turning off the gate of the PWM generator; P1102 (step S64), supply of power to all circuits is stopped (step S67).

While at least step S65 is completed in this sequence, an auxiliary power source; P26 keeps supplying power.

When the power switch is emergently shut down, supply of power is stopped by this sequence without degrading or damaging the device by an indeterminate power source voltage to the surface-conduction type device; P2001 of the display panel; P2000.

In this embodiment, when the power source is turned off, the gate of the PWM output unit; P1102 is controlled to be immediately turned off. Alternatively, the gate of the PWM output unit P1102 may be controlled by turning off the gate of a D/A unit; P1103 for controlling the current amplitude, or by turning off the gate of a pre-driver on the row wiring line; P2002 side.

In this embodiment, an output from the driving circuit unit is controlled by outputting a gate signal from the X & Y-driver timing generation unit P1001. However, the output control is not limited to this, and the MPU; P11 of the system control unit or another control system may be used.

The power source can be turned off by the same sequence even in a circuit arrangement in which the amplitude of luminance data is modulated to PWM-output correction data.

The image display apparatus control method of the present invention has been described. An image display apparatus will be explained.

(Arrangement and Manufacturing Method of Display Panel)

The arrangement and manufacturing method of the display panel of an image display apparatus to which the present invention is applied will be exemplified.

Figure 16:
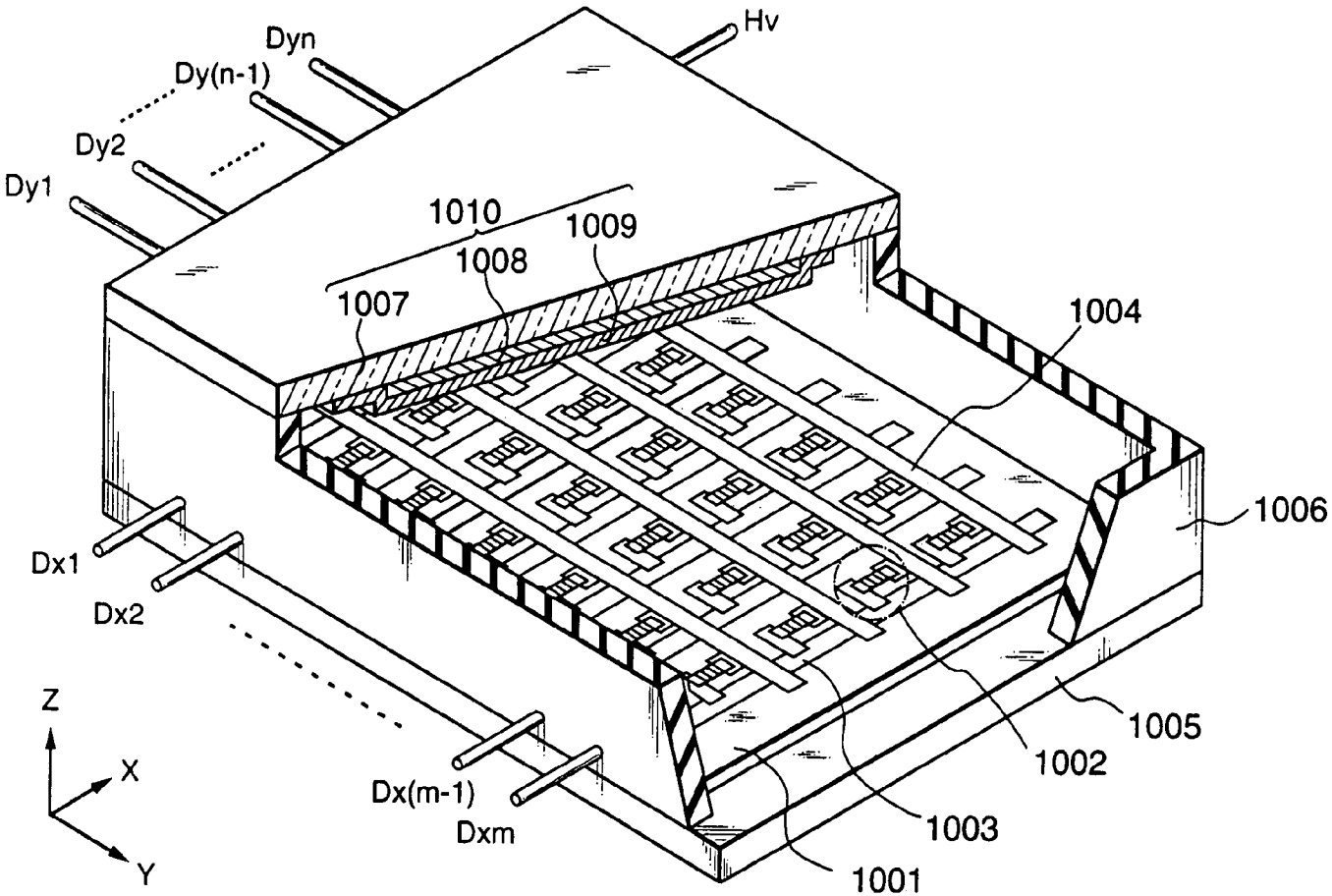
FIG. 16 is a perspective view showing a display panel.

FIG. 16 is a perspective view of the display panel used in this embodiment in which part of the panel is cut away in order to show the internal structure. In FIG. 16, reference numeral 1005 denotes a rear plate; 1006, a side wall; and 1007, a face plate. The rear plate 1005 to face plate 1007 constitute an airtight container for keeping the interior of the display panel vacuum. In assembling the airtight container, it is necessary to seal the container in order to make the joint portions of the respective members hold a sufficient strength and airtight condition. For example, frit glass is applied to joint portions, and baked in the outer air or a nitrogen atmosphere at 400 to 500° C. for 10 min or more, thereby sealing the container. A method for evacuating the airtight container will be described later.

A substrate 1001 is fixed to the rear plate 1005, and n×m cold cathode devices 1002 are formed on the substrate. (n and m are positive integers equal to 2 or more, and are properly set in accordance with a target number of display pixels. For example, in a display apparatus for high-resolution television display, n=3,000 or more, and m=1,000 or more are preferable. In this embodiment, n=3,072 or more, and m=1,024.) The n×m cold cathode devices are arranged in a simple matrix with m row-direction wiring lines 1003 and n column-direction wiring lines 1004. The portion constituted by the substrate 1001 to column-direction wiring lines 1004 is called a multi electron beam source. The manufacturing method and structure of the multi electron beam source will be described in detail later.

In FIG. 16, the substrate 1001 of the multi electron beam source is fixed to the rear plate 1005 of the airtight container. If, however, the substrate 1001 of the multi electron beam source has a sufficient strength, the substrate 1001 of the multi electron beam source may be used as the rear plate of the airtight container.

Figure 17:
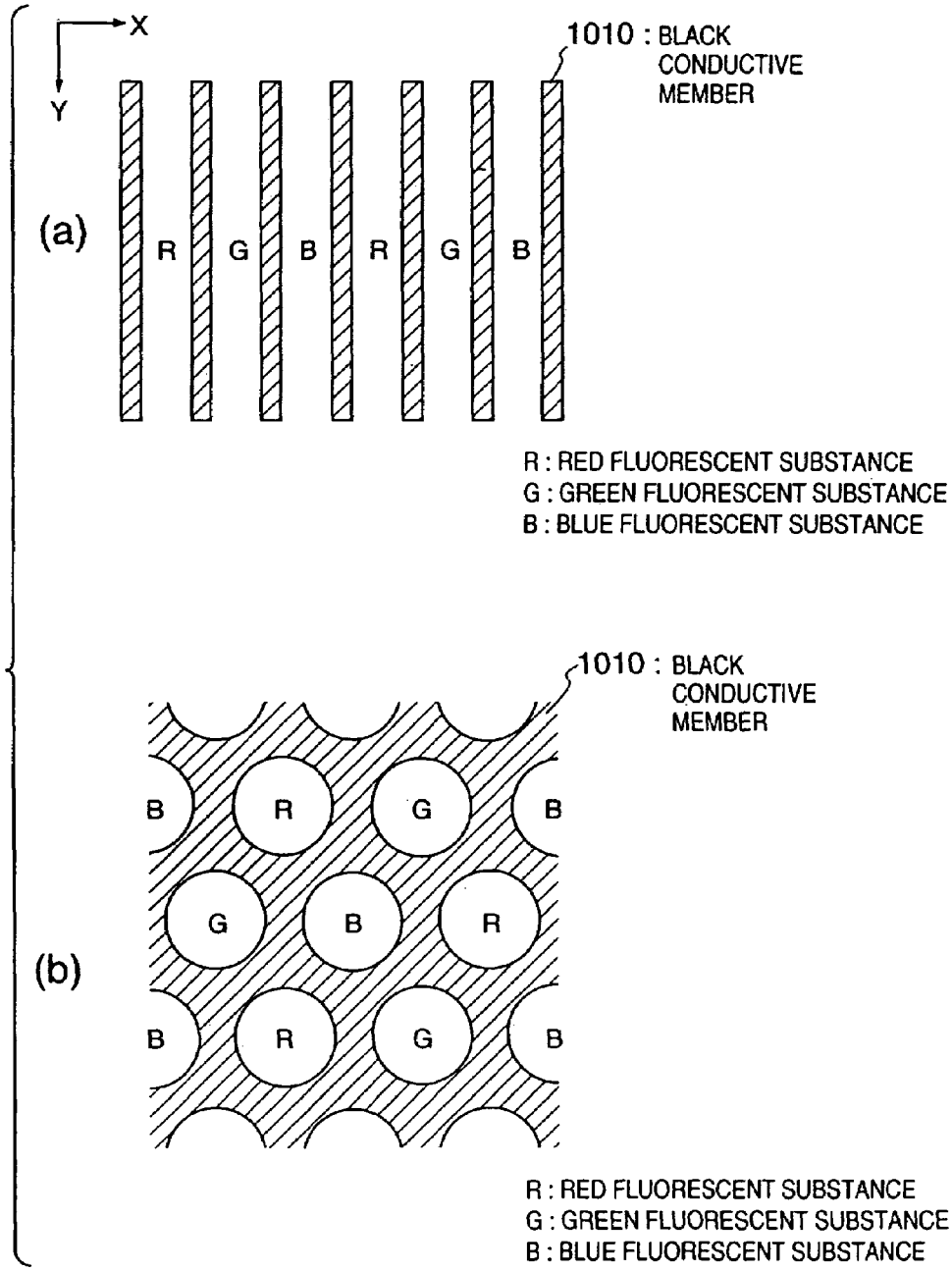
FIG. 17 shows views of the layouts of fluorescent substances.

A fluorescent film 1008 is formed on the lower surface of the face plate 1007. To display a color image by the fluorescent film 1008, the fluorescent film 1008 is coated with three, red, green, and blue primary color fluorescent substances used in the CRT field. As shown in FIG. 17(*a*), fluorescent substances of the respective colors are applied in stripes, and black conductive members 1010 are provided between the stripes of the fluorescent substances. The purpose of providing the black conductive members 1010 is to prevent display color misregistration even if the electron-beam irradiation position is shifted to some extent, to prevent a decrease in display contrast by shutting off reflection of external light, and to prevent charge-up of the fluorescent film by an electron beam. The black conductive members 1010 is mainly made of graphite, but may be made of another material as far as the material meets the purpose.

Fluorescent substances of the three primary colors are not limited to a striped layout shown in FIG. 17(*a*). For example, fluorescent substances may adopt a delta layout as shown in FIG. 17(*b*) or another layout.

In fabricating a monochrome display panel, a fluorescent substance material of a single color may be used for the fluorescent film 1008, and the black conductive member need not always be used.

A metal back 1009, which is well-known in the CRT field, is formed on a surface of the fluorescent film 1008 on the rear plate side. The purpose of forming the metal back 1009 is to improve the light utilization ratio by mirror-reflecting part of light emitted by the fluorescent film 1008, to protect the fluorescent film 1008 from collision with negative ions, to use the metal back 1009 as an electrode for applying an electron beam acceleration voltage, and to use the metal back 1009 as the conductive path of electrons which have excited the fluorescent film 1008. The metal back 1009 is formed by forming the fluorescent film 1008 on the face plate substrate 1007, smoothing the surface of the fluorescent film, and depositing Al on the smoothed surface by vacuum evaporation. If a low-voltage fluorescent substance material is used for the fluorescent film 1008, the metal back 1009 is not used.

To apply an acceleration voltage or improve the conductivity of the fluorescent film, transparent electrodes made of, e.g., ITO may be provided between the face plate substrate 1007 and the fluorescent film 1008.

Reference symbols Dx1 to Dxm, Dy1 to Dyn, and Hv denote electric connection terminals for the airtight structure that are provided to electrically connect the display panel and an electric circuit (not shown). Dx1 to Dxm are electrically connected to the row-direction wiring lines 1003 of the multi electron beam source; Dy1 to Dyn, to the column-direction wiring lines 1004 of the multi electron beam source; and Hv, to the metal back 1009 of the faceplate.

To evacuate the interior of the airtight container, an exhaust pipe and vacuum pump (neither is shown) are connected after the airtight container is assembled, and then the interior of the airtight container is evacuated to a vacuum degree of about $10^{-7}$ [Torr]. Thereafter, the exhaust pipe is sealed. To maintain the vacuum degree in the airtight container, a getter film (not shown) is formed at a predetermined position in the airtight container immediately before/after sealing. The getter film is a film formed by heating and evaporating a getter material mainly consisting of, e.g., Ba, by a heater or radio-frequency heating. The absorption effect of the getter film maintains a vacuum degree of $1\times10^{-5}$ to $1\times10^{-7}$ [Torr] in the airtight container.

(Manufacturing Method of Multi Electron Beam Source)

A method of manufacturing the multi electron beam source used in the display panel of this embodiment will be described. In the multi electron beam source used in the image display apparatus of the present invention, the material, shape, and manufacturing method of the cold cathode device are not particularly limited as long as an electron source is constituted by wiring cold cathode devices in a simple matrix. For example, cold cathode devices such as surface-conduction type emitting devices, FE type emitting devices, or MIM type emitting devices can be used.

Under circumstances where low-cost display apparatuses having large display screens are required, the surface-conduction type emitting device is especially preferable among these cold cathode devices. More specifically, the FE type device requires a high-precision manufacturing technique because the relative positions and shapes of the emitter cone and gate electrode greatly influence electron emission characteristics. This is disadvantageous in attaining a large area and low manufacturing cost. In the MIM type device, the insulating layer and upper electrode must be made thin and uniform. This is also disadvantageous in attaining a large area and low manufacturing cost.

In contrast to this, the surface-conduction type emitting device can be manufactured by a relatively simple method, and can achieve a large area and low manufacturing cost. The present inventors have also found that among the surface-conduction type emitting devices, a device having an electron-emitting portion or its peripheral portion made of a fine particle film exhibits excellent electron emission characteristics and can be easily manufactured. Such device is most preferably used in the multi electron beam source of a high-luminance, large-screen image display apparatus.

The basic arrangement, manufacture, and characteristics of a surface-conduction type emitting device preferable to the present invention will be described. After that, the structure of the multi electron beam source having many devices wired in a simple matrix will be described later. Note that the image display apparatus using the surface-conduction type emitting device will be called an SED (Surface conduction electron Emitter Display).

(Preferred Device Structure and Manufacturing Method of Surface-Conduction Type Emitting Device)

Typical arrangements of surface-conduction type emitting devices each having an electron-emitting portion or its peripheral portion made of a fine particle film include two types of devices, namely flat and stepped type devices.

(Flat Surface-Conduction Type Emitting Device)

The device structure and manufacturing method of a flat surface-conduction type emitting device will be described.

Figure 18:
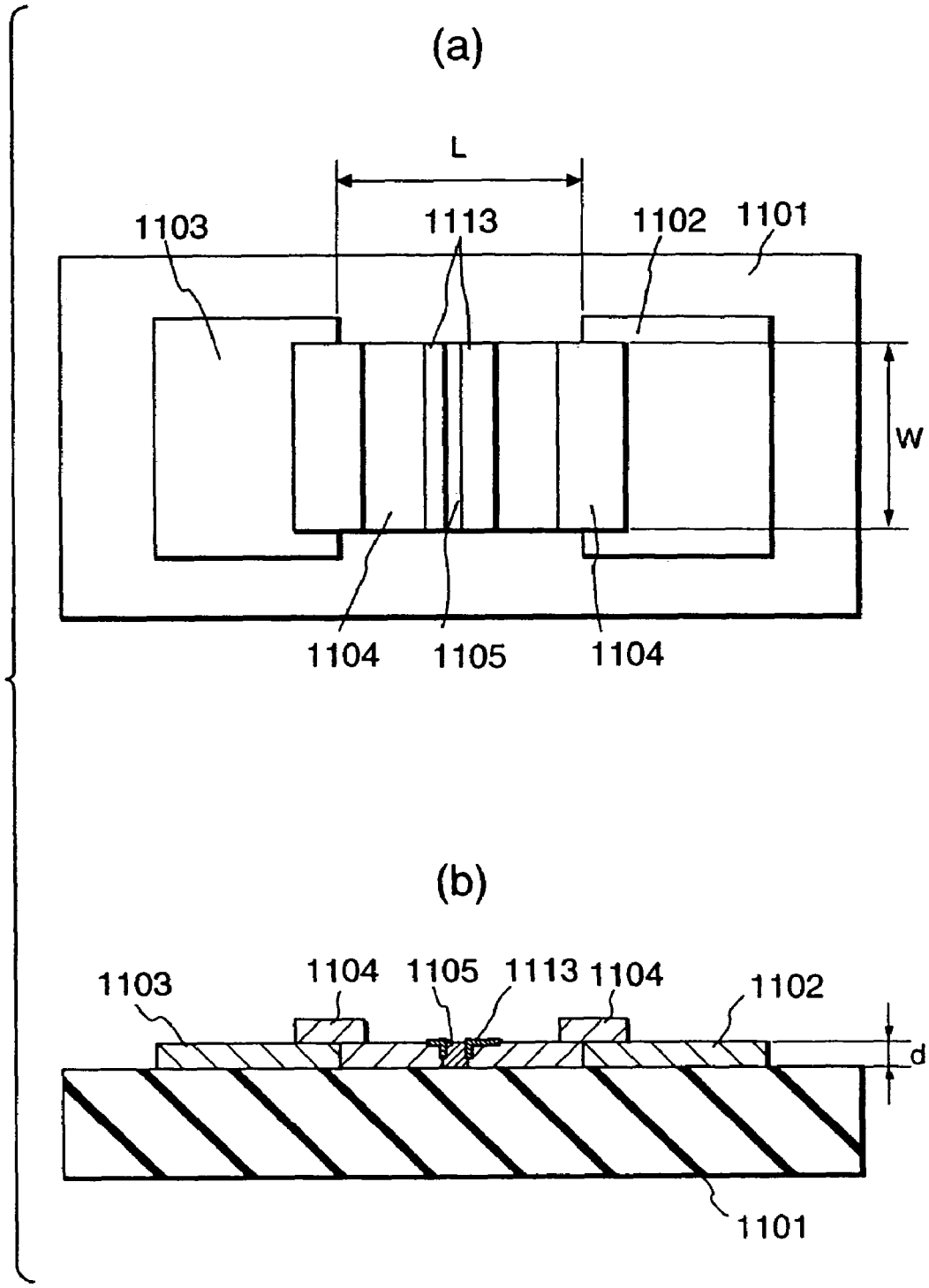
FIG. 18 shows a plan view and sectional view of a flat surface-conduction type electron-emitting device.

FIGS. 18(*a*) and 18(*b*) are a plan view and a sectional view, respectively, for explaining the arrangement of the flat surface-conduction type emitting device. Referring to FIG. 18, reference numeral 1101 denotes a substrate; 1102 and 1103, device electrodes; 1104, a conductive thin film; 1105, an electron-emitting portion formed by electrification forming processing; and 1113, a thin film formed by electrification activation processing.

As the substrate 1101, various glass substrates of quartz glass, soda-lime glass, and the like, various ceramic substrates of alumina and the like, or any of those substrates with an insulating layer formed thereon can be employed.

The device electrodes 1102 and 1103 which are formed on the substrate 1101 in parallel with the substrate surface so as to face each other are made of a conductive material. Examples of the material are metals such as Ni, Cr, Au, Mo, W, Pt, Ti, Cu, Pd, and Ag, alloys of these metals, metal oxides such as $In_2O_3$—$SnO_2$, and semiconductors such as polysilicon. These electrodes can be easily formed by a combination of a film formation technique such as vacuum evaporation and a patterning technique such as photolithography or etching. Another method (e.g., printing technique) may be used.

The shape of the device electrodes 1102 and 1103 is appropriately designed in accordance with the application purpose of the electron-emitting device. In general, an interval L between the electrodes is designed by selecting an appropriate value in a range of several hundred A to several hundred μm. The most preferable range applied to a display apparatus is from several μm to several ten μm. As for a thickness d of the device electrode, an appropriate value is selected in a range of several hundred Å to several μm.

The conductive thin film 1104 is formed from a fine particle film. The fine particle film is a film that contains a lot of fine particles (including islands like masses of particles) as film-constituting members. In microscopic view, individual fine particles exist to be apart from each other, to be adjacent to each other, or to overlap each other.

A fine particle used for the fine particle film has a diameter falling within a range of several Å to several thousand Å, and preferably a range of 10 Å to 200 Å. The thickness of the fine particle film is properly set in consideration of the following conditions. That is, conditions necessary for electrically connecting the device electrode 1102 or 1103, conditions necessary for performing electrification forming (to be described later), and conditions necessary for setting the electrical resistance of the fine particle film to an appropriate value (to be described later). More specifically, the film thickness is set within a range of several Å to several thousand Å, and preferably a range of 10 Å to 500 Å.

Examples of a material used for forming the fine particle film are metals such as Pd, Pt, Ru, Ag, Au, Ti, In, Cn, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN, and HfN, semiconductors such as Si and Ge, and carbons. The material is appropriately selected from them.

As described above, the conductive thin film 1104 is formed from a fine particle film, and its sheet resistance is set to reside within a range of $10^3$ to $10^7$ (Ω/sq).

The conductive thin film 1104 and the device electrodes 1102 and 1103 partially overlap each other because they are desirably electrically connected to each other with high reliability. In FIG. 18, the conductive thin film 1104 and the device electrodes 1102 and 1103 are stacked in order of the substrate, device electrodes, and conductive thin film from the bottom, but may be stacked in order of the substrate, conductive thin film, and device electrodes from the bottom.

The electron-emitting portion 1105 is a fissured portion formed in part of the conductive thin film 1104, and has an electrically higher resistance than that of the peripheral conductive thin film. The fissure is formed by electrification forming processing (to be described later) in the conductive thin film 1104. In some cases, fine particles having a particle diameter of several Å to several hundred Å are set in the fissure. As it is difficult to exactly illustrate the actual position and shape of the electron-emitting portion, FIG. 3 schematically show the electron-emitting portion.

The thin film 1113, which is made of carbon or a carbon compound, covers the electron-emitting portion 1115 and its peripheral portion. The thin film 1113 is formed by electrification activation (to be described later) after electrification forming processing.

The thin film 1113 is preferably graphite monocrystalline, graphite polycrystalline, amorphous carbon, or mixture thereof, and its thickness is 500 [Å] or less, and more preferably 300 [Å] or less.

As it is difficult to exactly illustrate the actual position and shape of the thin film 1113, FIG. 3 schematically shows the thin film 1113. FIG. 3(*a*) shows a device in which part of the thin film 1113 is removed.

The basic arrangement of the preferred device has been described.

In this electron-emitting device, the substrate 1101 is made of soda-lime glass, and the device electrodes 1102 and 1103 are formed from an Ni thin film. The thickness d of the device electrode is 1,000 [Å], and the electrode interval L is 2 [μm].

The main material of the fine particle film is Pd or PdO. The fine particle film has a thickness of about 100 [Å] and a width W of 100 [Å].

Next, a method of manufacturing a preferred flat surface-conduction type emitting device will be described.

Figure 19:
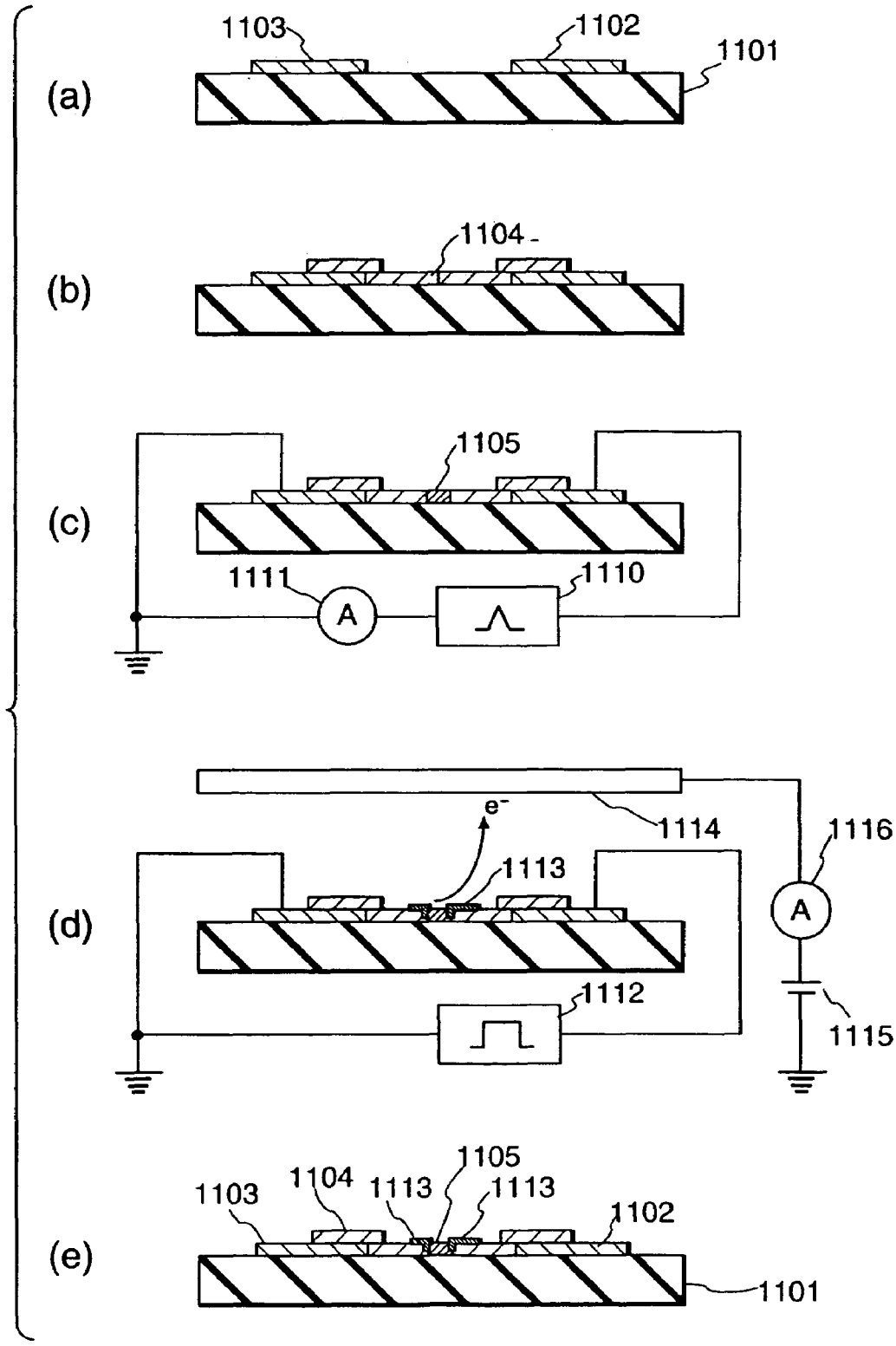
FIG. 19 shows sectional views of the steps in manufacturing a flat surface-conduction type electron-emitting device.
Figure 20:
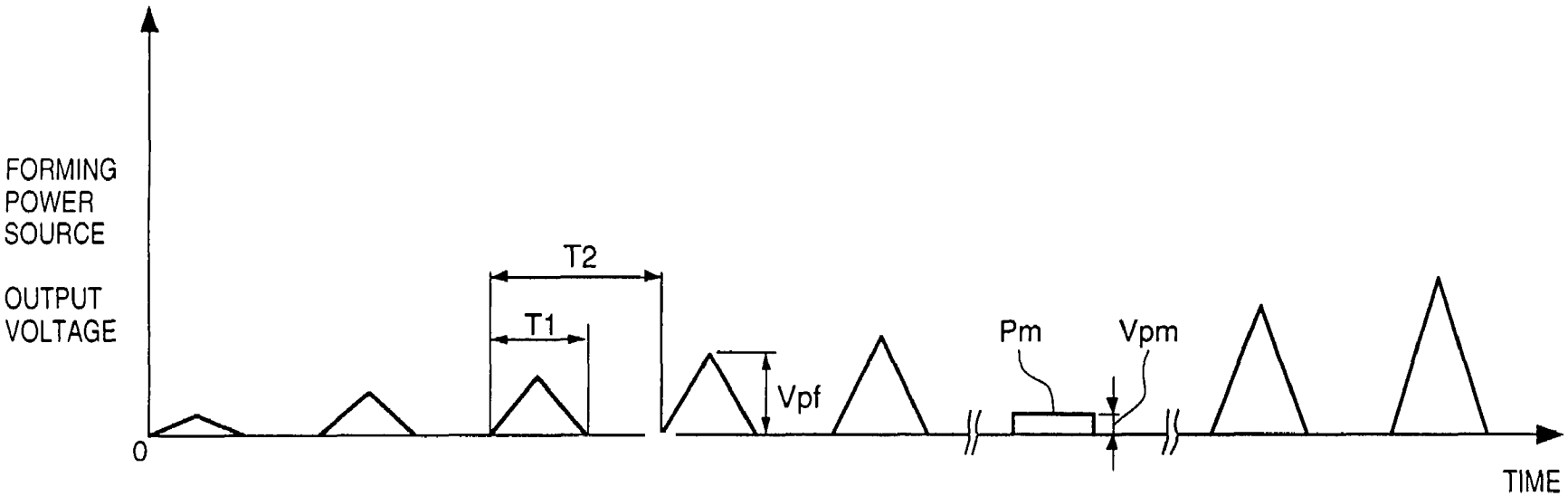
FIG. 20 is a waveform chart showing a forming voltage.

FIGS. 19(*a*) to 19(*d*) are sectional views for explaining the steps in manufacturing the surface-conduction type emitting device. The same reference numerals as in FIG. 18 denote the same parts.

As shown in FIG. 19(*a*), the device electrodes 1102 and 1103 are formed on the substrate 1101. In formation, the substrate 1101 is fully washed with a detergent, pure water, and an organic solvent, and the device electrode material is deposited on the substrate 1101. (As the deposition method, a vacuum film formation technique such as an evaporation method or sputtering method may be used.) The deposited electrode material is patterned by a photolithography etching technique into a pair of device electrodes (1102 and 1103) shown in FIG. 19(*a*).

As shown in FIG. 19(*b*), the conductive thin film 1104 is formed. In formation, an organic metal solution is applied to the substrate in FIG. 19(*a*), dried, and baked to form a fine particle film. The fine particle film is patterned into a predetermined shape by photolithography etching. The organic metal solution is an organic metal compound solution containing as a main element the fine particle material used for the conductive thin film. (More specifically, this embodiment uses Pd as a main element. This embodiment uses a dipping method as a coating method, but may use another method such as a spinner method or spraying method.)

The film formation method of the conductive thin film made from the fine particle film is not limited to the organic metal solution coating method used in the embodiment, but may be another method such as a vacuum evaporation method, sputtering method, or chemical vapor deposition method.

As shown in FIG. 19(*c*), a proper voltage is applied between the device electrodes 1102 and 1103 from a forming power source 1110 to perform electrification forming processing, thereby forming the electron-emitting portion 1105.

In electrification forming processing, electrification is done for the conductive thin film 1104 made from the fine particle film to properly damage, deform, or change in quality part of the conductive thin film 1104 so as to change it into a structure suitable for emitting electrons. An appropriate fissure is formed in the thin film at a portion of the conductive thin film made from the fine particle film that has changed into a structure suitable for emitting electrons (i.e., electron-emitting portion 1105). After the electron-emitting portion 1105 is formed, the electrical resistance measured between the device electrodes 1102 and 1103 greatly increases, compared to the electrical resistance before the electron-emitting portion 1105 is formed.

Figure 21:
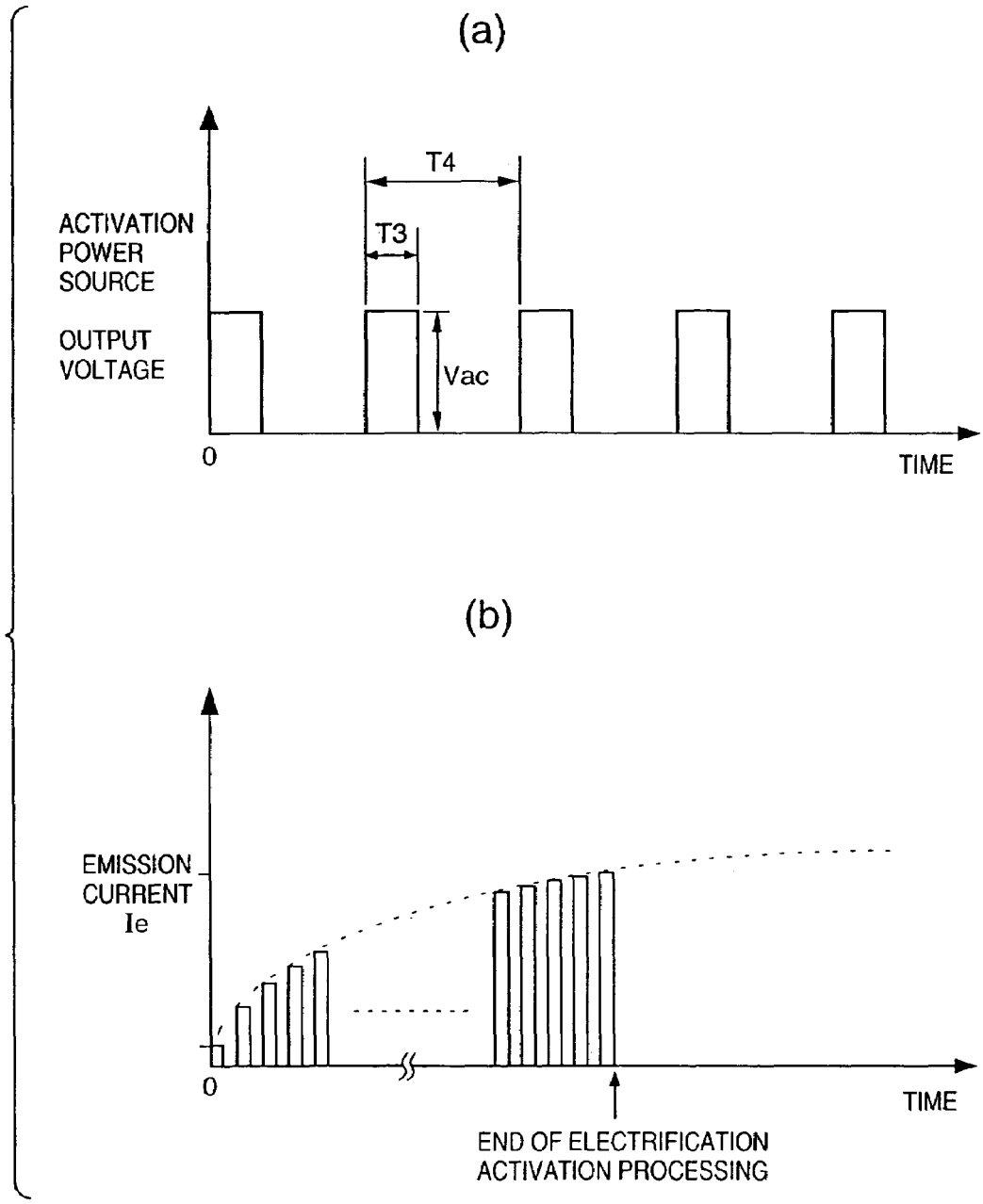
FIG. 21 shows waveform charts of an application voltage for electrification activation processing.

FIG. 21 shows an example of an appropriate voltage waveform applied from the forming power source 1110 in order to explain the electrification method in more detail. A pulse-like voltage is preferable to a case wherein forming is done for the conductive thin film made from the fine particle film. As shown in FIG. 21, a triangular-wave pulse having a pulse width T1 is continuously applied at a pulse interval T2. At this time, a peak value Vpf of the triangular-wave pulse is sequentially increased. Further, a monitor pulse Pm for monitoring the formation status of the electron-emitting portion 1105 is inserted between triangular-wave pulses at a proper interval, and a flowing current is measured by a galvanometer 1111.

More specifically, the peak value Vpf is increased by 01 [V] every pulse at the pulse width T1 of 1 [msec] and the pulse interval T2 of 10 [msec] in a vacuum atmosphere of about $10^{-5}$ [torr]. The monitor pulse Pm is inserted every time five triangular-wave pulses are applied. To avoid any adverse influence on forming processing, a monitor pulse voltage Vpm is set to 0.1 [V]. When the electrical resistance between the device electrodes 1102 and 1103 reaches $1\times10^{6}$ [Ω], i.e., a current measured by the galvanometer 1111 upon application of monitor pulses reaches $1\times10^{-7}$ [A] or less, electrification for forming processing ends.

Note that this method is preferable to the surface-conduction type emitting device of this embodiment. In case of changing the design of the surface-conduction type emitting device such as the material or thickness of the fine particle film or the device electrode interval L, the electrification conditions are desirably changed in accordance with the changed design.

As shown in FIG. 19(*d*), a proper voltage is applied between the device electrodes 1102 and 1103 from an activation power source 1112 to perform electrification activation processing so as to improve electron emission characteristics.

Electrification activation processing is processing of performing electrification for the electron-emitting portion 1105 formed by electrification forming processing under appropriate conditions, and depositing carbon or a carbon compound around the electron-emitting portion 1105. (In FIG. 19(*d*), a deposit of carbon or a carbon compound is illustrated as a material 1113.) Compared to an emission current before electrification activation processing, electrification activation processing can increase an emission current typically 100 times or more at the same application voltage.

More specifically, a voltage pulse is periodically applied in a vacuum atmosphere of $10^{-4}$ to $10^{-5}$ [torr] to deposit carbon or a carbon compound derived from an organic compound existing in the vacuum atmosphere. The deposit 1113 is graphite monocrystalline, graphite polycrystalline, amorphous carbon, or mixture thereof. The thickness of the accumulated material 1113 is 500 [Å] or less, and more preferably 300 [Å] or less.

FIG. 21(*a*) shows an example of an appropriate voltage waveform applied from the activation power source 1112 in order to explain the electrification method in more detail. For example, a rectangular-wave voltage Vac is 14 [V], a pulse width T3 is 1 [msec], and a pulse interval T4 is 10 [msec]. These electrification conditions are preferable to the surface-conduction type emitting device of this embodiment. In case of changing the design of the surface-conduction type emitting device, the electrification conditions are preferably changed in accordance with the changed design.

Reference numeral 1114 shown in FIG. 19(*d*) denotes an anode electrode for capturing an emission current Ie emitted from the surface-conduction type emitting device. The anode electrode 1114 is connected to a DC high-voltage power source 1115 and galvanometer 1116. (In case of performing activation processing after the substrate 1101 is incorporated in the display panel, the fluorescent surface of the display panel is used as the anode electrode 1114.)

While a voltage from the activation power source 1112 is applied, the galvanometer 1116 measures the emission current Ie, and monitors the progress of electrification activation processing to control the operation of the activation power source 1112. FIG. 6(*b*) shows an example of the emission current Ie measured by the galvanometer 1116. As the activation power source 1112 starts applying a pulse voltage, the emission current Ie increases with the elapse of time, gradually comes into saturation, and hardly increases. When the emission current Ie substantially saturates, application of the voltage from the activation power source 1112 is stopped to stop electrification activation processing.

Note that these electrification conditions are preferable to the surface-conduction type emitting device of this embodiment. In case of changing the design of the surface-conduction type emitting device, the conditions are preferably changed in accordance with the changed design.

In this manner, the flat surface-conduction type emitting device shown in FIG. 19(*e*) is manufactured.

(Stepped Surface-Conduction Type Emitting Device)

Another typical arrangement of the surface-conduction type emitting device having an electron-emitting portion or its peripheral portion formed from a fine particle film, i.e., a stepped surface-conduction type emitting device will be described.

Figure 22:
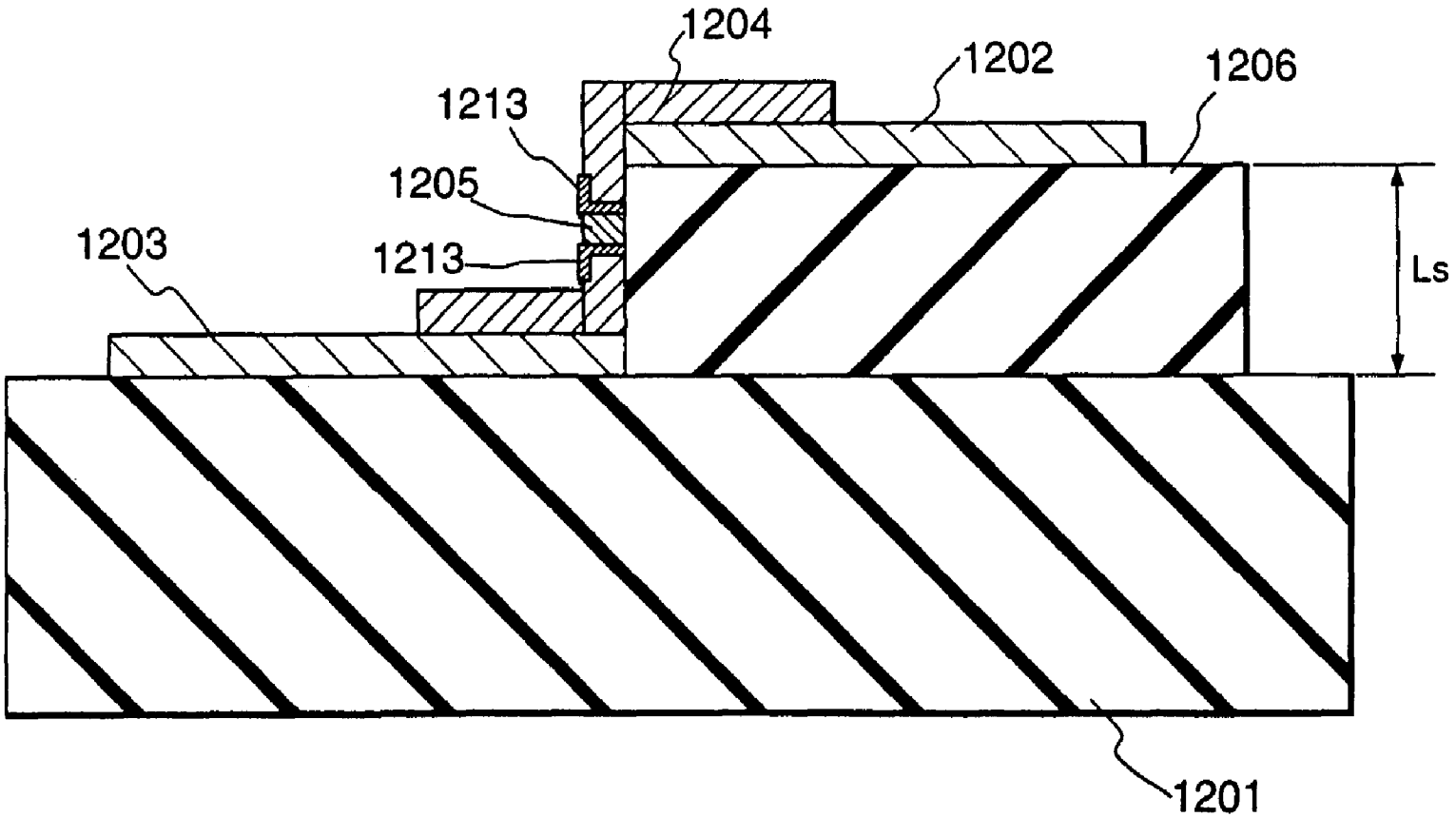
FIG. 22 is a sectional view showing a stepped surface-conduction type electron-emitting device.

FIG. 22 is a schematic sectional view for explaining the basic arrangement of the stepped surface-conduction type emitting device. In FIG. 22, reference numeral 1201 denotes a substrate; 1202 and 1203, device electrodes; 1206, a step-forming member; 1204, a conductive thin film using a fine particle film; 1205, an electron-emitting portion formed by electrification forming processing; and 1213, a thin film formed by electrification activation processing.

The stepped device is different from the flat device described above in that one of the device electrodes (1202) is formed on the step-forming member 1206 and the conductive thin film 1204 covers the side surface of the step-forming member 1206. The device electrode interval L in FIG. 18 is set as a step height Ls of the step-forming member 1206 in the stepped device. The substrate 1201, device electrodes 1202 and 1203, and conductive thin film 1204 using the fine particle film can use the materials listed in the description of the flat device. The step-forming member 1206 uses an electrically insulating material such as $SiO_2$.

Figure 23:
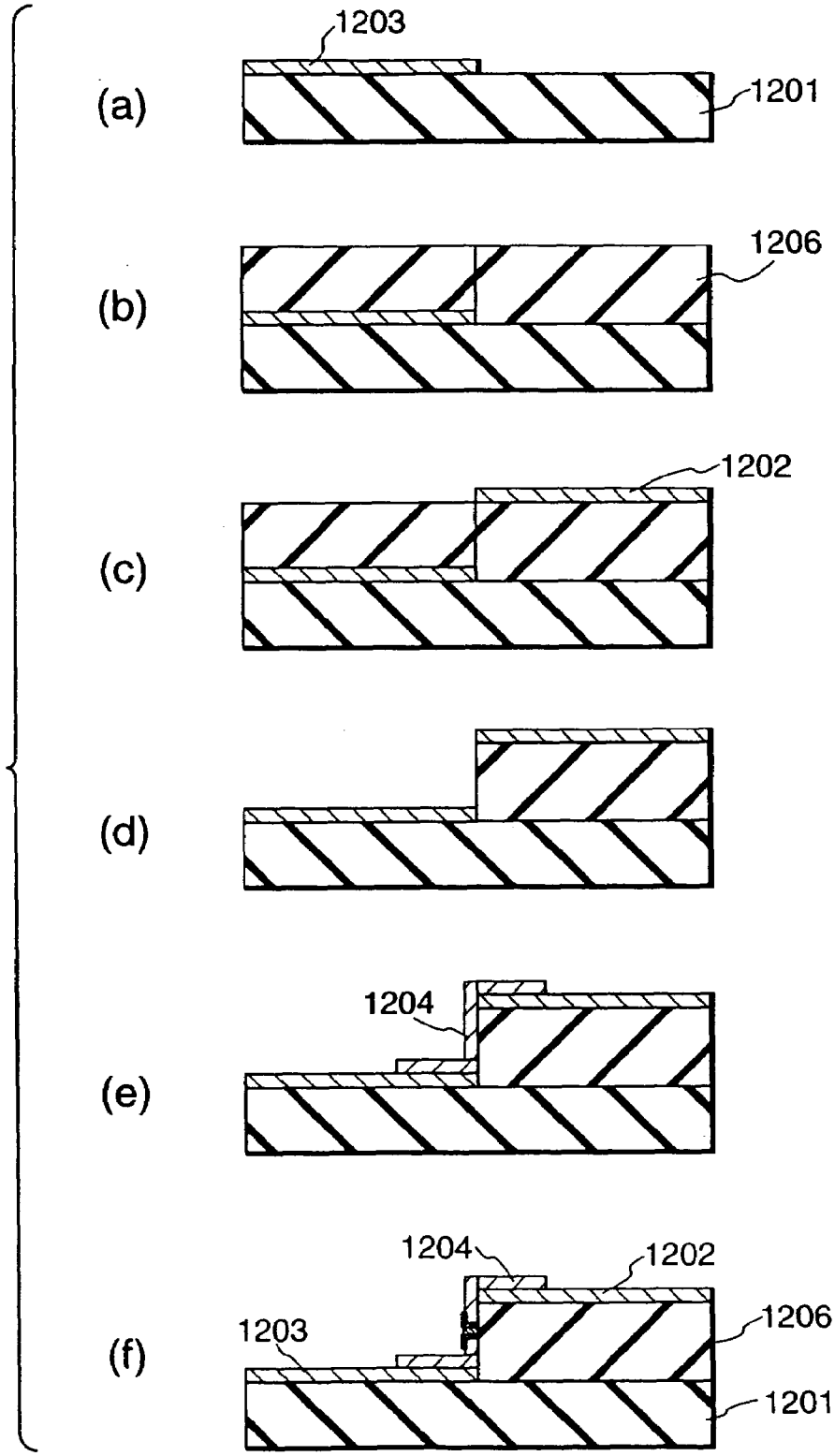
FIG. 23 shows sectional views of the steps in manufacturing a stepped surface-conduction type electron-emitting device.

A method of manufacturing the stepped surface-conduction type emitting device will be described with reference to FIG. 23. FIGS. 23(*a*) to 23(*f*) are sectional views for explaining the manufacturing steps. The same reference numerals as in FIG. 22 denote the same parts.

As shown in FIG. 23(*a*), the device electrode 1203 is formed on the substrate 1201.

As shown in FIG. 23(*b*), an insulating layer for forming the step-forming member is stacked. The insulating layer may be stacked by sputtering, e.g., $SiO_2$, but may be formed by another film formation method such as a vacuum evaporation method or printing method.

As shown in FIG. 23(*c*), the device electrode 1202 is formed on the insulating layer.

As shown in FIG. 23(*d*), part of the insulating layer is etched away to expose the device electrode 1203.

As shown in FIG. 23(*e*), the conductive thin film 1204 using the fine particle film is formed. To form the film 1204, a film formation technique such as a coating method is used similar to the flat device.

Similar to the flat device, electrification forming processing is performed to form an electron-emitting portion. (The same processing as electrification forming processing for the flat device described with reference to FIG. 4(*c*) is performed).

Similar to the flat device, electrification activation processing is done to deposit carbon or a carbon compound around the electron-emitting portion. (The same processing as electrification activation processing for the flat device described with reference to FIG. 4(*d*) is performed).

In this fashion, the stepped surface-conduction type emitting device shown in FIG. 23(*f*) is manufactured.

(Characteristics of Surface-Conduction Type Electron-Emitting Device Used in Display Apparatus)

The characteristics of the surface-conduction type electron-emitting device used in the display apparatus will be described.

Figure 24:
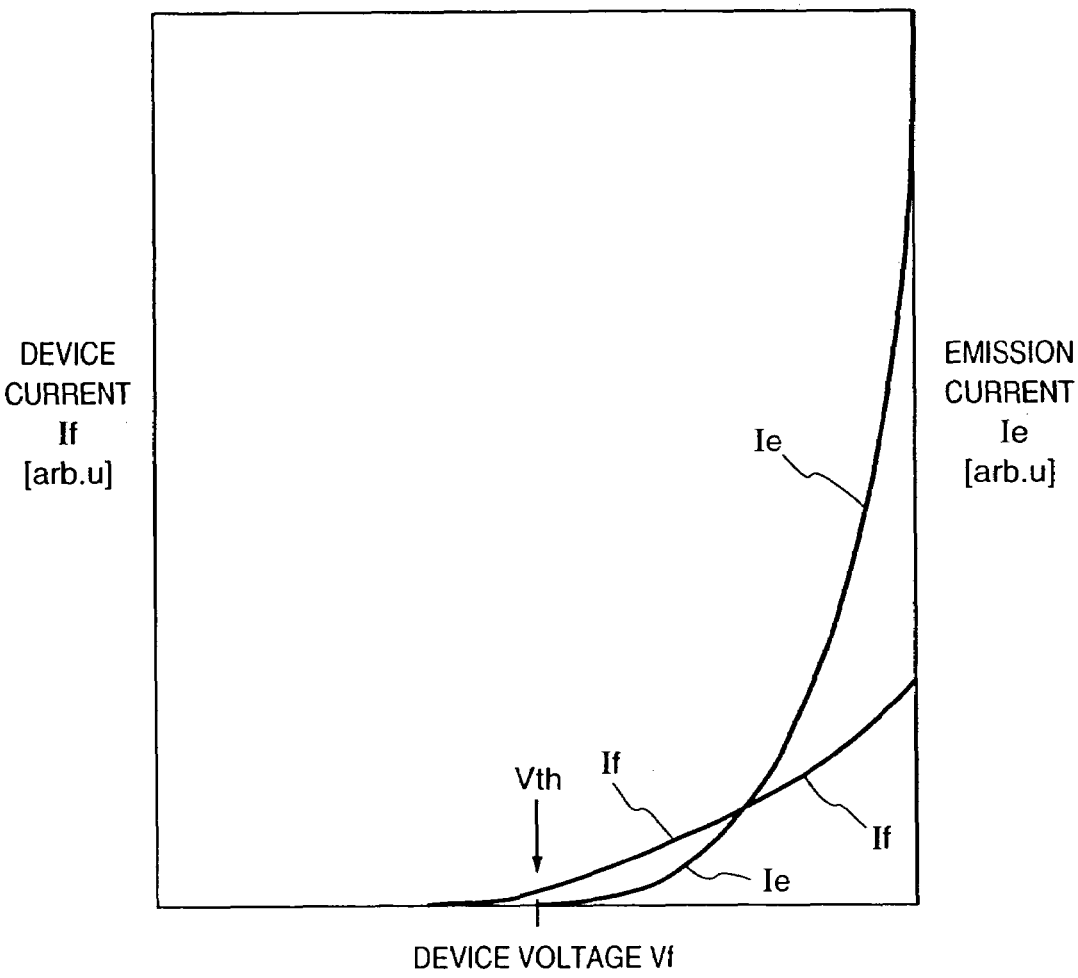
FIG. 24 is a graph showing the characteristics of an electron-emitting device.

FIG. 24 shows typical examples of the (emission current Ie) vs. (device application voltage Vf) characteristic and (device current If) vs. (device application voltage Vf) characteristic of the device used in the display apparatus. The emission current Ie is much smaller than the device current If, and is difficult to illustrate by the same measure as the device current If. In addition, these characteristics change when design parameters such as the size and shape of the device are changed. Thus, the two characteristics of the graph are illustrated in arbitrary units.

Regarding the emission current Ie, the device used in the display apparatus has the following three characteristics:

First, when a voltage equal to or higher than a given voltage (to be referred to as a threshold voltage Vth) is applied to the device, the emission current Ie drastically increases. At a voltage lower than the threshold voltage Vth, almost no emission current Ie is detected.

In other words, the device is a nonlinear device with the clear threshold voltage Vth for the emission current Ie.

Second, the emission current Ie changes depending on the device application voltage Vf, so that the magnitude of the emission current Ie can be controlled by the voltage Vf.

Third, the current Ie emitted by the device at the device application voltage Vf exhibits a high response speed. Hence, the charge amount of electrons emitted by the device can be controlled by the application time of the voltage Vf.

The surface-conduction type emitting device having these characteristics can be preferably applied to the display apparatus. For example, if a display apparatus having many devices in correspondence with the pixels of a display screen uses the first characteristic, the display screen is sequentially scanned to display an image. This means that the threshold voltage Vth or more is properly applied to a device during driving in accordance with a desired emission luminance, whereas a voltage lower than the threshold voltage Vth is applied to an unselected device. By sequentially switching devices to be driven, the display screen can be sequentially scanned to display an image.

By using the second or third characteristic, the emission luminance can be controlled to realize tone level display.

As a supplemental remark of FIG. 24, the device current If has a nonlinear characteristic which projects downward, similar to the emission current, but has a characteristic that a small current flows even at a voltage lower than the threshold current Vth.

(Structure of Multi Electron Beam Source with Many Devices Wired in Simple Matrix)

The structure of the multi electron beam source in which surface-conduction type emitting devices are arranged on a substrate and wired in a simple matrix will be described.

Figure 25:
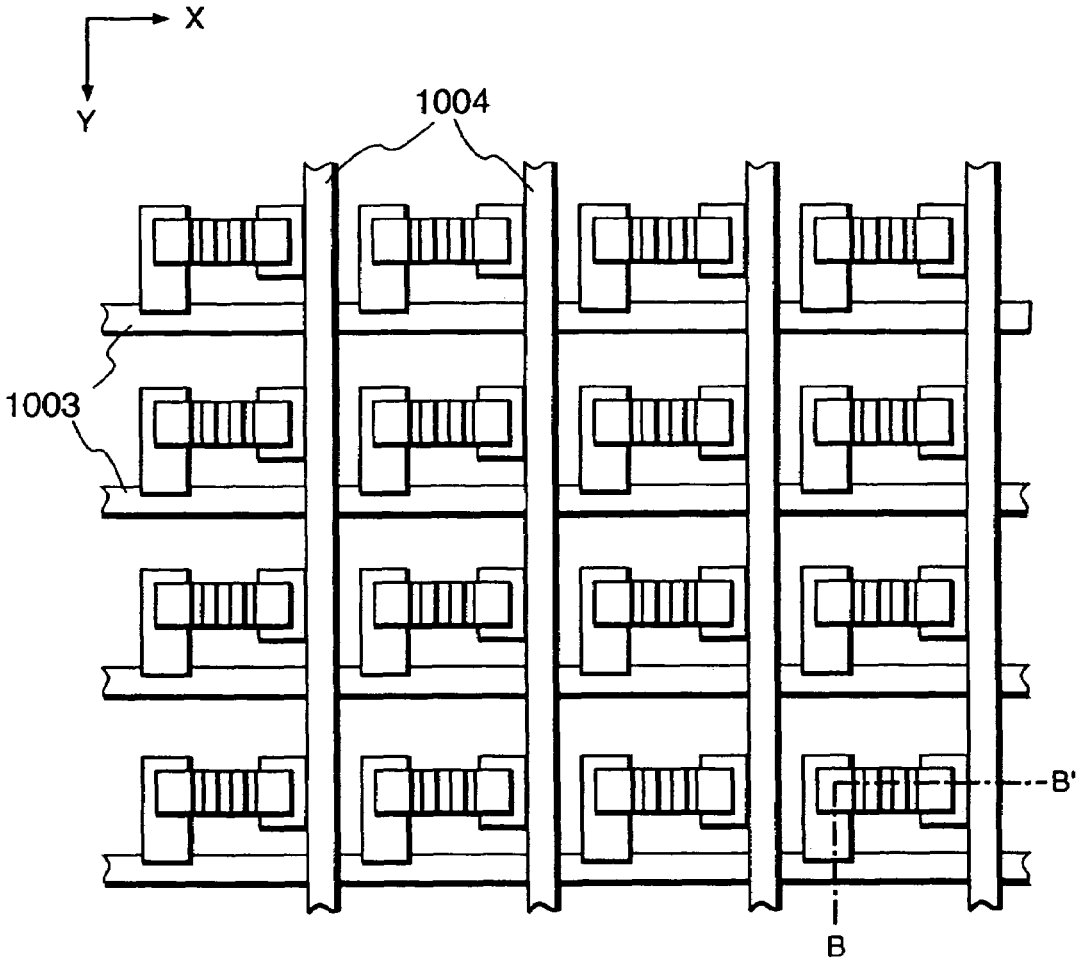
FIG. 25 is a plan view showing a multi electron beam source.

FIG. 25 is a plan view of the multi electron beam source used in the display panel of FIG. 16. Surface-conduction type emitting devices like the one shown in FIG. 18 are arranged on a substrate. These devices are wired in a simple matrix by the row-direction wiring electrodes 1003 and column-direction wiring electrodes 1004. At each intersection of the row-direction wiring electrode 1003 and column-direction wiring electrodes 1004, an insulating layer (not shown) is formed between the electrodes to maintain electrical insulation.

Figure 26:
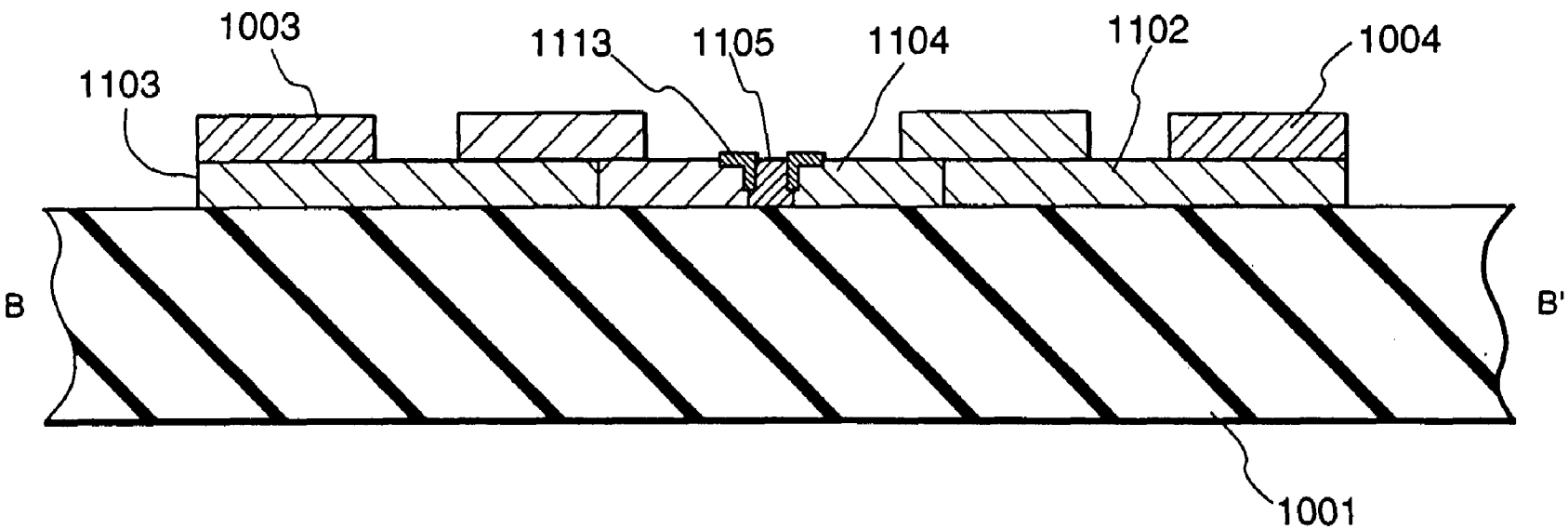
FIG. 26 is a sectional view showing the multi electron beam source taken along the line B-B'.
Figure 28:
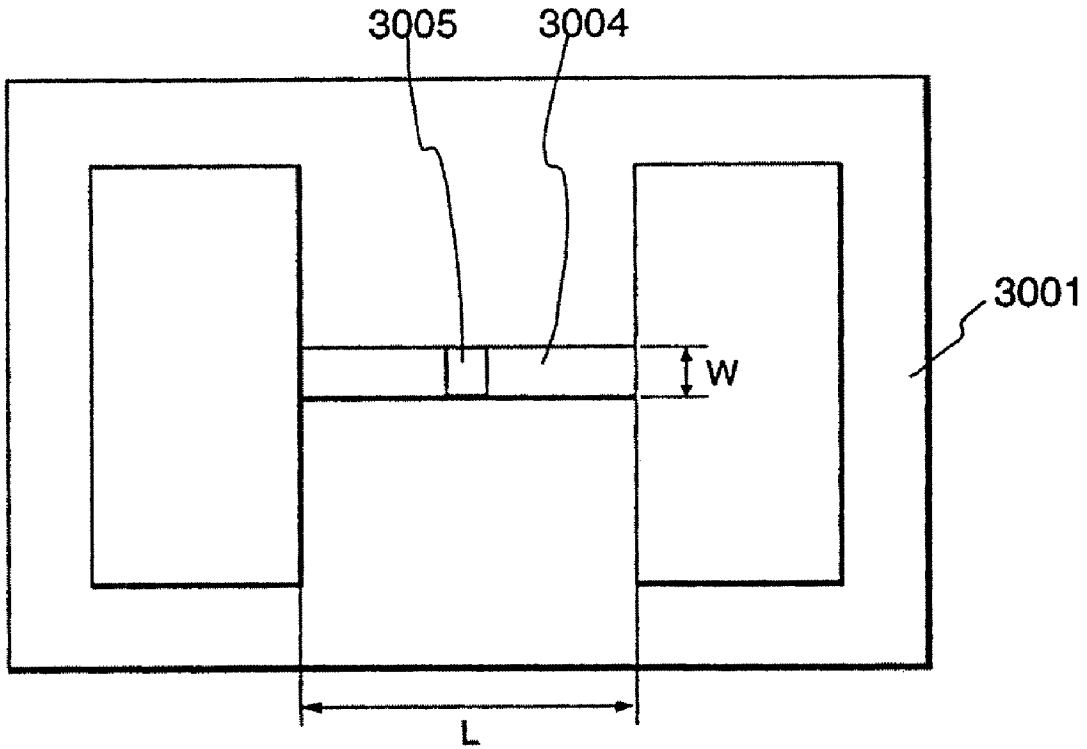
FIG. 28 PRIOR ART
FIG. 28 is a plan view showing a conventional surface-conduction type electron-emitting device.
Figure 29:
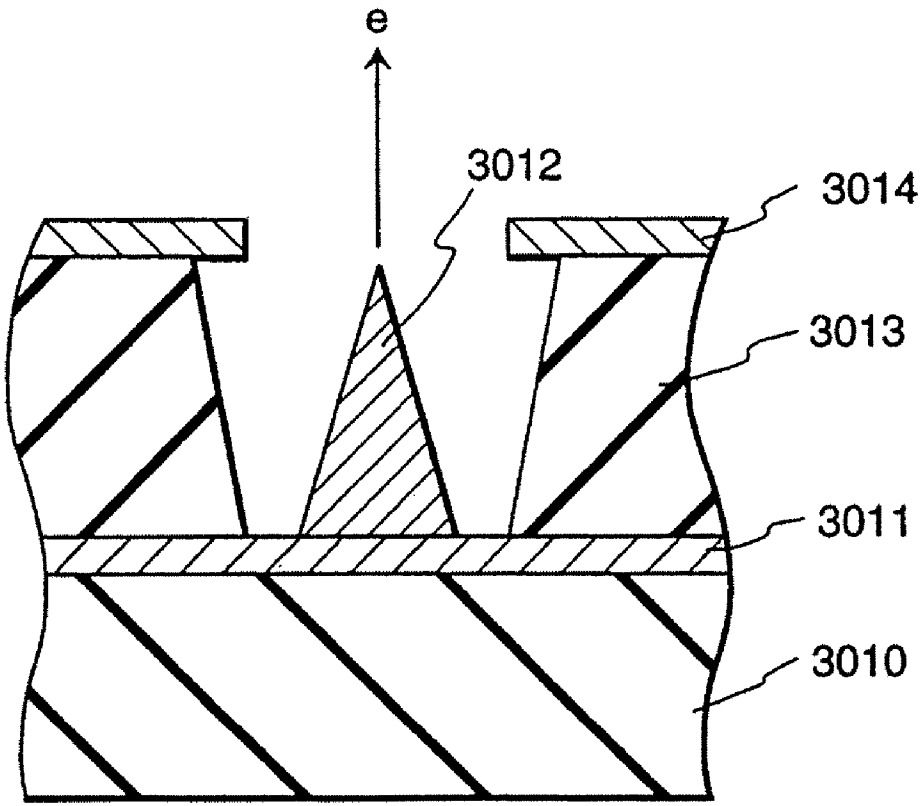
FIG. 29 PRIOR ART
FIG. 29 is a sectional view showing a conventional field emission type electron-emitting device.
Figure 30:
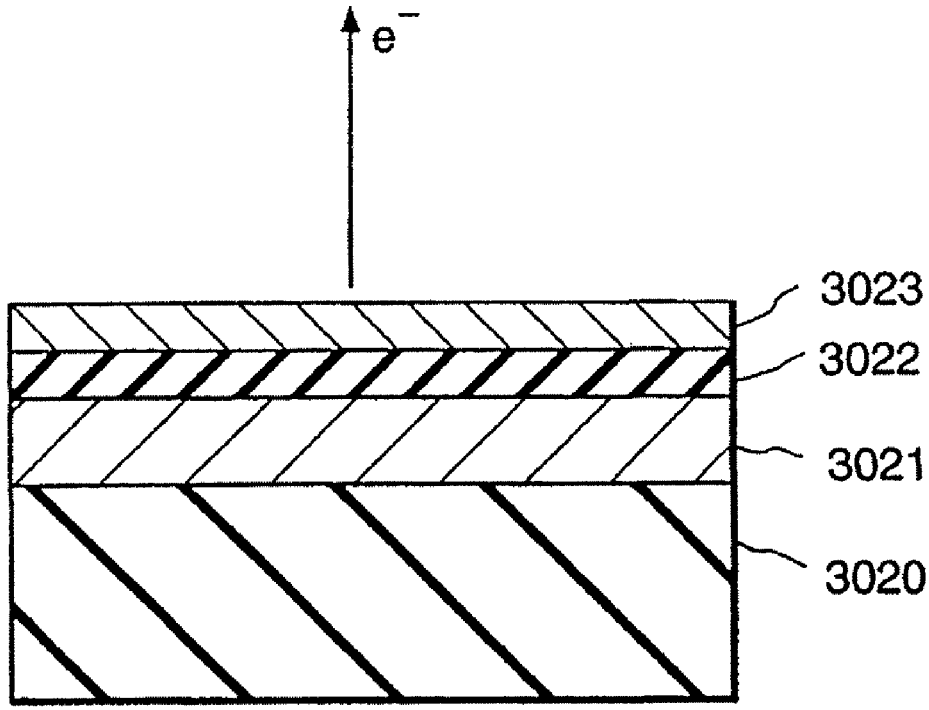
FIG. 30 PRIOR ART
FIG. 30 is a sectional view showing a conventional MIM type electron-emitting device.
Figure 31:
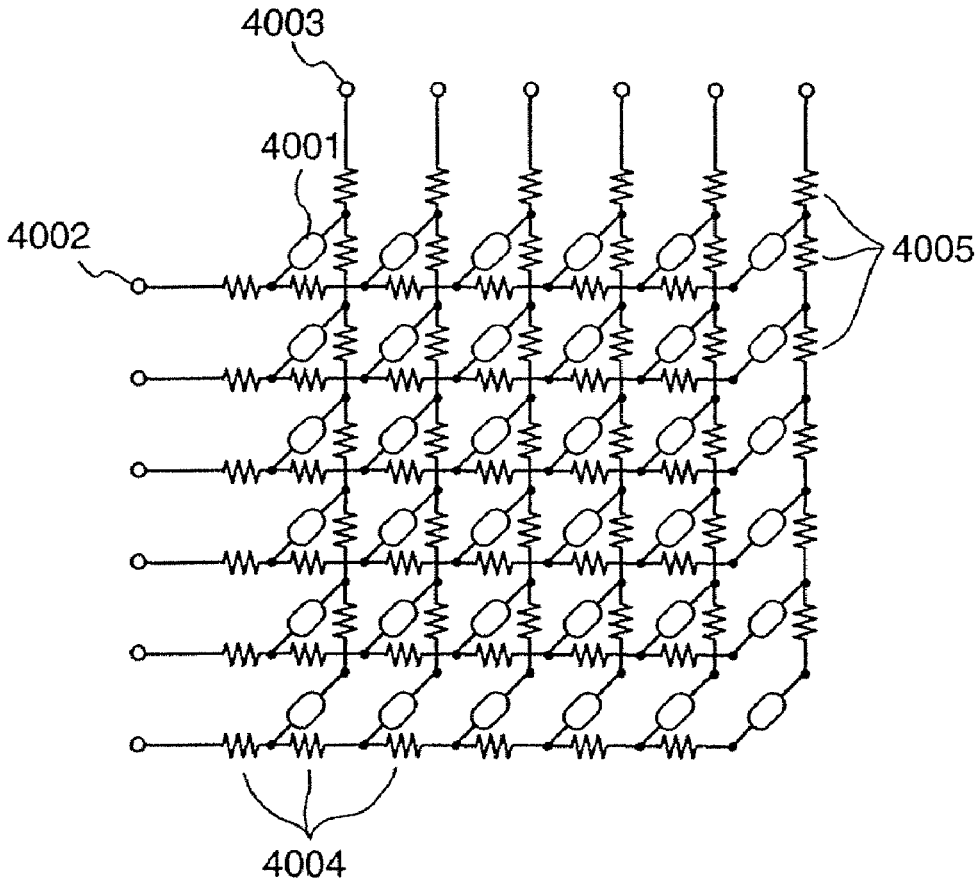
FIG. 31 PRIOR ART
FIG. 31 is a circuit diagram showing the layout of electron-emitting devices that has been examined by the present inventor to find a problem.

FIG. 26 is a sectional view take along the line B-B' in FIG. 25.

A multi electron source having this structure is manufactured by forming in advance on the substrate the row-direction wiring electrodes 1003, and column-direction wiring electrodes 1004, insulating layers (not shown) between the electrodes, and the device electrodes and conductive thin films of the surface-conduction type emitting device, and supplying power to respective devices via the row-direction wiring electrodes 1003 and column-direction wiring lines 1004 to perform electrification forming processing and electrification activation processing.

FIG. 27 is a block diagram showing a display panel using the surface-conduction type emitting device described above as an electron beam source.

In FIG. 27, reference numeral 2100 denotes a display panel; 2101, a driving circuit for the display panel; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion. (When this display apparatus receives a signal containing both image information and audio information such as a TV signal, the apparatus displays the image information while reproducing the audio information. A description of a circuit or a speaker regarding reception, division, reproduction, processing, storage, or the like of the audio information, which is not directly related to the features of the present invention, will be omitted.)

The functions of the respective units will be explained along the flow of an image signal.

The TV signal reception circuit 2113 is a circuit for receiving a TV image signal transmitted using a radio transmission system such as radio waves or spatial optical communication. The scheme of a TV signal to be received is not particularly limited, and can employ various schemes such as the NTSC scheme, PAL scheme, and SECAM scheme. A TV signal (so-called high-quality TV signal of the MUSE scheme or the like) realized by a larger number of scanning lines than the above-mentioned schemes is a preferable signal source to take the advantages of the display panel which can realize a large area and a large number of pixels. The TV signal received by the TV signal reception circuit 2113 is output to the decoder 2104.

The TV signal reception circuit 2112 receives a TV image signal transmitted using a wire transmission system such as a coaxial cable or optical fiber. The scheme of a TV signal to be received is not particularly limited, similar to the TV signal reception circuit 2113. The TV signal received by the circuit 2112 is also output to the decoder 2104.

The image input interface circuit 2111 is a circuit for receiving an image signal supplied from an image input device such as a TV camera or image read scanner, and outputs the received image signal to the decoder 2104.

The image memory interface circuit 2110 is a circuit for receiving an image signal stored in a video tape recorder (to be briefly referred to as a VTR hereinafter), and outputs the received image signal to the decoder 2104.

The image memory interface circuit 2109 is a circuit for receives an image signal stored in a video disk, and outputs the received image signal to the decoder 2104.

The image memory interface circuit 2108 is a circuit for receiving an image signal from a device such as a so-called still image disk which stores still image data, and outputs the received still image data to the decoder 2104.

The I/O interface circuit 2105 is a circuit for connecting the display apparatus to an external computer, computer network, or output device such as a printer. The I/O interface circuit 2105 allows inputting/outputting image data, character•graphic information, and in some cases allows inputting/outputting a control signal and numerical data between the CPU 2106 of the display apparatus and an external device.

The image generation circuit 2107 generates display image data on the basis of image data or character•graphic information externally input via the I/O interface circuit 2105, or image data or character•graphic information output from the CPU 2106. This circuit incorporates circuits necessary to generate images such as a programmable memory for storing image data and character•graphic information, a read-only memory storing image patterns corresponding to character codes, and a processor for performing image processing. Display image data generated by the circuit is output to the decoder 2104. In some cases, display image data can also be output to an external computer network or printer via the I/O interface circuit 2105.

The CPU 2106 mainly performs operation control of the display apparatus, and operations concerning generation, selection, and editing of display images.

For example, the CPU 2106 outputs a control signal to the multiplexer 2103 to properly select or combine image signals to be displayed on the display panel. At this time, the CPU 2106 generates a control signal to the display panel controller 2102 in accordance with an image signal to be displayed, and appropriately controls the operation of the display apparatus in terms of the screen display frequency, the scanning method (e.g., interlaced or non-interlaced scanning), the number of scanning lines for one frame, and the like. The CPU 2106 directly outputs image data or character•graphic information to the image generation circuit 2107. In addition, the CPU 2106 accesses an external computer or memory via the I/O interface circuit 2105 to input image data or character•graphic information.

The CPU 2106 may also be concerned with operations for other purposes. For example, the CPU 2106 can be directly concerned with the function of generating and processing information, like a personal computer or word processor.

Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse.

The decoder 2104 is a circuit for inversely converting various image signals input from the circuits 2107 to 2113 into three primary color signals, or a luminance signal, I signal, and Q signal. As is indicated by the dotted line in FIG. 27, the decoder 2104 desirably incorporates an image memory in order to process a TV signal of the MUSE scheme or the like which requires an image memory in inverse conversion. Using the image memory advantageously facilitates display of a still image, or image processing and editing such as thinning, interpolation, enlargement, reduction, and synthesis of images in cooperation with the image generation circuit 2107 and CPU 2106.

The multiplexer 2103 appropriately selects a display image on the basis of a control signal input from the CPU 2106. More specifically, the multiplexer 2103 selects a desired image signal from inversely converted image signals input from the decoder 2104, and outputs the selected image signal to the driving circuit 2101. In this case, image signals can be selectively switched within a 1-frame display time to display different images in a plurality of areas of one frame, like a so-called multiwindow television.

The display panel controller 2102 is a circuit for controlling the operation of the driving circuit 2101 on the basis of a control signal input from the CPU 2106.

As the basic operation of the display panel, the display panel controller 2102 outputs, e.g., a signal for controlling the operation sequence of a driving power source (not shown) of the display panel to the driving circuit 2101.

As the display panel driving method, the display panel controller 2102 outputs, e.g., a signal for controlling the screen display frequency or scanning method (e.g., interlaced or non-interlaced scanning) to the driving circuit 2101.

In some cases, the display panel controller 2102 outputs to the driving circuit 2101 a control signal concerning adjustment of the image quality such as the luminance, contrast, color tone, or sharpness of a display image.

The driving circuit 2101 is a circuit for generating a driving signal to be applied to the display panel 2100, and operates based on an image signal input from the multiplexer 2103 and a control signal input from the display panel controller 2102.

The functions of the respective units have been described. With the arrangement shown in FIG. 12, the display apparatus can display pieces of image information input from various image information sources on the display panel 2100.

More specifically, various image signals of television broadcasting and the like are inversely converted by the decoder 2104, properly selected by the multiplexer 2103, and input to the driving circuit 2101. The display controller 2102 generates a control signal for controlling the operation of the driving circuit 2101 in accordance with an image signal to be displayed. The driving circuit 2101 applies a driving signal to the display panel 2100 on the basis of the image signal and control signal.

As a result, an image is displayed on the display panel 2100.

A series of operations are systematically controlled by the CPU 2106.

This display apparatus can simply display an image selected from a plurality of pieces of image information with the image memory incorporated in the decoder 2104, the image generation circuit 2107, and the CPU 2106. In addition, the display apparatus can perform, for image information to be displayed, image processing such as enlargement, reduction, rotation, movement, edge enhancement, thinning, interpolation, color conversion, and conversion of the aspect ratio of an image, and image editing such as synthesis, erase, connection, exchange, and pasting. Although not mentioned in this embodiment, a dedicated circuit for processing and editing audio information may be adopted, similar to image processing and image editing.

The display apparatus can function as a display device for television broadcasting, a terminal device for video conferences, an image editing device for processing still images and dynamic images, a terminal device for a computer, an office terminal device such as a wordprocessor, a game device, and the like. This display apparatus can be variously applied for industrial and business purposes.

FIG. 27 merely shows an example of the arrangement of the display apparatus using the display panel having a surface-conduction type emitting device as an electron beam source. The present invention is not limited to this. For example, a circuit associated with a function unnecessary for the application purpose may be eliminated from the building elements in FIG. 27. To the contrary, another building element may be added in accordance with the application purpose. For example, when the display apparatus is used as a television telephone set, transmission and reception circuits including a television camera, audio microphone, lighting, and modem are preferably added to the building elements.

The display panel using particularly a surface-conduction type emitting device as an electron beam source can be easily made thin in the display apparatus, which can reduce the depth of the whole display apparatus. In addition, the display panel using a surface-conduction type emitting device as an electron beam source easily implements a large screen, and exhibits high luminance and wide view angle. Accordingly, this display apparatus can display an impressive image with reality and high visibility.

INDUSTRIAL APPLICABILITY

The present invention can suppress an erroneous display and suppress degradation in characteristics in executing power-on, power-off, and emergency power source shutdown sequences for an image display apparatus.

What is claimed is:

1. An image display apparatus control method comprising, when image display is to be started by outputting a signal from a modulation circuit to a display panel for displaying an image by irradiation with electrons from an electron source to fluorescent substances, delaying application of a predetermined acceleration potential for accelerating electrons from the electron source, wherein said image display apparatus comprises a processor unit, a D/A converter which inputs a signal from said processor unit, and a high voltage source which inputs a signal from said D/A converter and outputs the acceleration potential for accelerating electrons from the electron source, wherein said modulation circuit has a shift register holding data for outputting the signal, said processor unit outputs, to said D/A converter, a control signal for raising the potential to be outputted from said high voltage source to a predetermined potential when a predetermined time period has been elapsed after a power source was turned on, and determines the data to be stored in the shift register during the predetermined time period.

2. The image display apparatus control method according to claim 1, wherein the predetermined time period is a time during which a predetermined number of sync signals of image signals is counted.

3. The image display apparatus control method according to claim 1, wherein the electron source comprises a plurality of row-direction wiring lines for receiving a scanning signal, a plurality of column-direction wiring lines for receiving a modulation signal, and a plurality of electron-emitting devices connected to the row-direction wiring lines and the column-direction wiring lines.

4. An image display apparatus control method comprising, when image display is to be started by outputting a signal from a scanning circuit to a display panel for displaying an image by irradiation with electrons from an electron source to fluorescent substances, delaying application of a predetermined acceleration potential for accelerating electrons from the electron source, wherein said image display apparatus comprises a processor unit, a D/A converter which inputs a signal from said processor unit, and a high voltage source which inputs a signal from said D/A converter and outputs the acceleration potential for accelerating electrons from the electron source, wherein said scanning circuit has a shift register holding data for outputting the signal, said processor unit outputs, to said D/A converter, a control signal for raising the potential to be outputted from said high voltage source to a predetermined potential when a predetermined time period has been elapsed after a power source was turned on, and determines the data to be stored in the shift register during the predetermined time period.

5. The image display apparatus control method according to claim 4, wherein the predetermined time period is a time during which a predetermined number of sync signals of image signals is counted.

6. The image display apparatus control method according to claim 4, wherein the electron source comprises a plurality of row-direction wiring lines for receiving a scanning signal, a plurality of column-direction wiring lines for receiving a modulation signal, and a plurality of electron-emitting devices connected to the row-direction wiring lines and the column-direction wiring lines.

* * * * *

UNITED STATES PATENT AND TRADEMARK OFFICE

CERTIFICATE OF CORRECTION

PATENT NO. : 7,268,750 B2
APPLICATION NO. : 11/226821
DATED : September 11, 2007
INVENTOR(S) : Aoji Isono et al.

It is certified that error appears in the above-identified patent and that said Letters Patent is hereby corrected as shown below:

ON THE TITLE PAGE [56] REFERENCES CITED:

Foreign Patent Documents:

"JP 60-216387 4/1984" should read --JP 60-216387 10/1985--;
"JP 60-216387 10/1985" should be deleted;
"1031332" should read --1-031332--;
"02272490" should read --2-272490--;
"02273720" should read --2-273720--;
"2257551" should read --2-257551--;
"03048889" should read --3-048889--;
"3055738" should read --3-055738--;
"4028137" should read --4-028137--;
"04204993" should read --4-204993--;
"WO WO96/15519 5/1996" should read --WO 96/15519 5/1996--; and
--EP 0 707 301 A1 4/1996-- should be inserted.

Other Publications:

"Strong Election Emission From Patterned Tin-Indium Oxide Thin Films", M. Hartwell et al., International Electron Devices Meeting, Washington DC (1975) pp. 519-521." should read --Strong Electron Emission From Patterned Tin-Indium Oxide Thin Films", M. Hartwell et al., International Electron Devices Meeting, Washington DC (1975) pp. 519-521.--; and
"Physical Properties of Thin-Film Field Emission Cathodes With Molybedium Cones", J. Appl. Phys., 47, 5248 (1976), pp. 5248-5263." should read --Physical Properties of Thin-Film Field Emission Cathodes With Molydenum Cones", J. Appl. Phys., 47, 5248 (1976), pp. 5248-5263.--.

SHEET 6:

Fig. 6, "REGURATOR" should read --REGULATOR-- and "RAGURATOR" should read --REGULATOR--.

UNITED STATES PATENT AND TRADEMARK OFFICE

CERTIFICATE OF CORRECTION

PATENT NO. : 7,268,750 B2
APPLICATION NO. : 11/226821
DATED : September 11, 2007
INVENTOR(S) : Aoji Isono et al.

It is certified that error appears in the above-identified patent and that said Letters Patent is hereby corrected as shown below:

SHEET 7:

Fig. 7, "REGURATOR" should read --REGULATOR-- and "RAGURATOR" should read --REGULATOR--.

COLUMN 2:

Line 15, "denium" should read --denum--; and
Line 66, "and 4-2813.7" should read --and 4-28137--.

COLUMN 3:

Line 19, "Microele-ctronics" should read --Microelectronics--.

COLUMN 6:

Line 20, "Source" should read --source--.

COLUMN 12:

Line 59, "units" should read --unit--.

COLUMN 17:

Line 58, "becomes 35 V" should read --becomes 3.5 V--.

COLUMN 21:

Line 67, "agate" should read --a gate--.

COLUMN 22:

Line 29, "generator." should read --generator--.

COLUMN 26:

Line 28, "is" should read --are--.

UNITED STATES PATENT AND TRADEMARK OFFICE

CERTIFICATE OF CORRECTION

PATENT NO. : 7,268,750 B2
APPLICATION NO. : 11/226821
DATED : September 11, 2007
INVENTOR(S) : Aoji Isono et al.

It is certified that error appears in the above-identified patent and that said Letters Patent is hereby corrected as shown below:

COLUMN 28:

Line 23, "hundred A" should read --hundred Å--.

COLUMN 29:

Line 7, "show" should read --shows--.

COLUMN 30:

Line 29, "by 01" should read --by 0.1--.

COLUMN 32:

Line 23, "formed)." should read --formed.)--; and
Line 29, "performed)." should read --performed.)--.

COLUMN 34:

Line 22, "receives" should read --receiving--.

Signed and Sealed this

Fifth Day of August, 2008

JON W. DUDAS
*Director of the United States Patent and Trademark Office*